US007490425B2

(12) United States Patent
Crowell et al.

(10) Patent No.: US 7,490,425 B2
(45) Date of Patent: Feb. 17, 2009

(54) THREE-DIMENSIONAL FOLDING GRAPHICS SYSTEM

(75) Inventors: Christopher S. Crowell, Lyme, CT (US); Joseph R. Klim, New Britain, CT (US)

(73) Assignee: Dimensional Communications Inc., Chester, CT (US)

( * ) Notice: Subject to any disclaimer, the term of this patent is extended or adjusted under 35 U.S.C. 154(b) by 253 days.

(21) Appl. No.: 11/491,558

(22) Filed: Jul. 24, 2006

(65) Prior Publication Data

US 2007/0017133 A1 Jan. 25, 2007

Related U.S. Application Data

(60) Provisional application No. 60/702,371, filed on Jul. 25, 2005.

(51) Int. Cl.
*G09F 1/00* (2006.01)

(52) U.S. Cl. ..... 40/610; 40/124.01

(58) Field of Classification Search ..... 40/124.01, 40/124.19, 610, 780; 434/135, 406; 273/156; 446/108, 109, 122, 124, 125, 487, 488
See application file for complete search history.

(56) References Cited

U.S. PATENT DOCUMENTS 1,891,011 A * 12/1932 Purdy ..... 446/109
2,868,568 A * 1/1959 Frye ..... 403/171
3,343,297 A * 9/1967 Valentine ..... 446/109
4,620,842 A 11/1986 Wang
4,635,411 A * 1/1987 Kurzen ..... 52/71
5,281,181 A * 1/1994 McCollum ..... 446/106
5,711,099 A 1/1998 Nesbit et al.
5,712,446 A * 1/1998 Spence ..... 102/348
5,865,660 A * 2/1999 Smith ..... 446/106
6,042,022 A 3/2000 Rogozinski et al.
6,171,560 B1 1/2001 Pesu et al.
6,193,106 B1 2/2001 Ho et al.
6,386,370 B1 5/2002 Wigton et al.

* cited by examiner

*Primary Examiner*—Joanne Silbermann
(74) *Attorney, Agent, or Firm*—Melvin I. Stoltz

(57) ABSTRACT

By providing a housing member within which all of the required elements are pre-formed and constructed as a display system which enables any desired graphics to be inserted therein to form an integral part of the assembly, a unique, printed, visually exciting and interest generating foldable, three-dimensional display system is attained. In accordance with the present invention, the interest generating, foldable display system of the present invention is quickly and easily automatically erected from its flat, generally two-dimensional configuration into a three-dimensional display. Furthermore, the housing preferably comprises an enlarged internal cavity for receiving any desired display element. In this way, the display assembly is easily, and automatically converted from a two-dimensional, substantially flat configuration into a three-dimensional fully erected, interest generating, visually exciting display.

24 Claims, 25 Drawing Sheets

22

23

20

21

22

20

21

THREE-DIMENSIONAL FOLDING GRAPHICS SYSTEM

RELATED APPLICATIONS

This application is related to U.S. Provisional Patent Application Ser. No. 60/702,371, filed Jul. 25, 2005 entitled FOLDABLE DISPLAY SYSTEM.

TECHNICAL FIELD

This invention relates to display systems and, more particularly, to foldable three-dimensional display systems formed from a plurality of flat panels.

BACKGROUND ART

With the ever increasing and widening interests of consumers and the variety of products which consumers wish to purchase, manufacturers have sought to provide competitive products which will satisfy consumers' interests and desires. In this regard, inexpensive or reasonably priced display systems have long been an area of interest for consumers, particularly those display systems which provide appealing, visually exciting and interest generating images.

In an attempt to meet and satisfy consumers' desires, numerous pop-up displays, greeting cards, display cards, and dioramas have been offered for sale in a wide variety of alternate configurations and appearances. However, in spite of the effort expended by many companies to satisfy consumer interests, these prior art products have generally failed to provide the desired interest generating results, in a reasonably priced consumer product. Typically, these prior art products employ complex systems which produce three-dimensional displays when unfolded or erected. However, in spite of some visually unique appearances being generated by such products, the overall cost of production and complexity of assembly for these systems have prevented the systems from becoming popular and/or saleable.

Other prior art display systems have attempted to generate consumer interest by providing unique visual images or other indicia as an integral part of a display. However, these prior art attempts have also failed to generate the interest being sought, largely due to an inability to achieve an easily erected and employable product.

Therefore, it is a principal object of the present invention to provide a visually attractive, interest generating display system which is capable of being produced at a reasonable cost and provides an exciting, visually stimulating display.

Another object of the present invention is to provide a visually attractive, interest generating display system having the characteristic features described above which is in the form of a foldable display system, which is quickly and easily employed by the consumer for movement between a substantially flat configuration into a three-dimensional, fully erect display configuration.

Another object to the present invention is to provide a visually attractive, interest generating foldable display system having the characteristic features described above which is capable of mass production and assembly.

Another object of the present invention is to provide a visually attractive, interest generating foldable display system having the characteristic features described above which provides a unique, eye-catching and exciting display which can be widely varied for satisfying diverse consumer interests.

Another object to the present invention is to provide a visually attractive, interest generating foldable display system having the characteristic features described above which is shippable and transportable in a completely flat configuration, while being manually or automatically erectable, whenever desired, into the three-dimensional visually attractive display.

Other and more specific objects will in part be obvious and will in part appear hereinafter.

SUMMARY OF THE INVENTION

By employing the present invention, all of the difficulties and inabilities of the prior art are eliminated and a unique, printed, visually exciting and interest generating foldable, three-dimensional display system is attained which is capable of being constructed quickly and easily. These desirable results are achieved in the present invention by providing a unique, housing member within which all of the required elements are pre-formed and constructed as a display system which enables any desired unique graphics to be inserted therein to form an integral part of the assembly. The housing is shipped or stored in a substantially flat, folded configuration, fully assembled and ready for any desired graphic to be integrated therewith. In addition, in accordance with the unique aspects of the present invention, the interest generating, foldable display system of the present invention is quickly and easily automatically erected from its flat, generally two-dimensional configuration into a three-dimensional display possessing all of the attributes desired by consumers.

In accordance with the present invention, a housing is provided which is constructed for being quickly, easily, and automatically converted from a two-dimensional, substantially flat configuration into a three-dimensional, fully erected, interest generating, visually exciting display incorporating a unique construction or numerous, integrated components, each of which are pre-cut and lockingly interconnected. Although prior art constructions exist for various foldable display members, the present invention provides a unique construction which achieves a foldable display, which is able to be constructed in a manner which substantially reduces the manual effort required in prior art constructions.

In this regard, in one preferred embodiment of the present invention, the foldable display is constructed in two sections, a base member and a display member. Although this construction can be presented in numerous, alternate visual configurations, the present invention is easily exemplified by a foldable globe construction, having a base or support member and a foldable display member, preferably in the form of a spherical, globe-forming member. In addition, a particular, desired, visually exciting display element is positioned in the center of the globe or sphere.

Although prior art, foldable globe constructions exist, these prior art products must be individually constructed and assembled, with each new display element requiring a new design or construction in order to achieve the final product. As a result, a substantial expense is incurred in both design and assembly for achieving each new product display. However, by employing the present invention, all of these difficulties are eliminated.

In the present invention, each base member is substantially identical in construction incorporating a plurality of separate panel members which are interlocked with each other to form the foldable base. In addition, some of the panel members incorporate receiving slots formed therein which are constructed for enabling the other elements of the final assembly to be affixed thereto.

Although the panels forming the base of each desired product are constructed in a substantially identical manner and configuration, the panels of different products may incorporate distinct indicia printed thereon, or any desired, visual appearance, color, graphics, etc. As a result, each similarly constructed base of each unique product may appear substantially different from each other.

Another unique aspect of the present invention is the creation of the display zone or portion of the overall assembly in a standardized configuration for all different products. In this regard, in one exemplary embodiment wherein the display zone-or portion is a spherical display member, each spherical or globe-shaped display member is constructed from a plurality of separate panel members mounted in interlocked interengagement with each other to form the desired visual configuration. By employing this construction, the sphere or globe is securely retained in interlocked engagement, while also being completely foldable between a substantially flat configuration and a fully erect, three-dimensional configuration.

In addition, in the preferred embodiment, the display zone or portion also incorporates a central opening or cavity formed therein within which any desired display element can be easily mounted. In this way, the display element may comprise a plurality of panels having a unique visual configuration, a single panel, pictures, logos, display pieces, three-dimensional objects, diorama displays, or any other desired element or configuration.

By employing this construction, any desired display element can be quickly and easily mounted to either the display zone or portion, the supporting base, or both components for being securely retained and visually displayed in a unique, exciting, and distinctive manner. In addition, by using standardized components which are quickly and easily assembled into the overall display system, with these components having a receiving zone within which the unique, distinctive display element can be quickly and easily positioned and secured, an overall display system is realized which is capable of satisfying all of the needs and desires of the consuming public, while also being achievable in a cost effective manner.

In constructing the foldable, three-dimensional display system of the present invention, any desired panel construction, configuration, and visual appearance can be employed for either the base or the display zone or portion. In the spherically shaped globe example of the present invention, it has been found that the panel members forming the globe display portion are preferably formed from transparent or translucent material, in order to provide the visual appearance of a conventional snow globe, while also enabling the display portion positioned in a centrally formed cavity thereof to be easily viewed through the transparent panel members. In this regard, if desired, varying indicia, decorative effects, etc. can be printed on the panel members, in order to enhance and emphasize any particular visual impression desired. Furthermore, a wide variety of alternate construction details or interlocking panel configurations can also be employed for achieving a particular desired visual impression.

As is evident from the foregoing detailed discussion, by employing the present invention, a completely foldable, easily movable three-dimensional display system is realized which enables the system to be quickly and easily converted from a substantially flat, two-dimensional configuration into the desired, three-dimensional, display configuration, wherein all of the components and the decorative indicia are displayed in position, ready for viewing and enjoyment. By merely moving the display system from a flat, folded configuration, into the desired three-dimensional configuration, the entire display system is quickly and easily erected, ready for use and enjoyment.

Furthermore, if desired, the foldable three-dimensional display system of the present invention may be constructed with a self-erecting element incorporated therein in order to provide a self activating system for moving between the two alternate positions. As a result, increased interest, excitement and enjoyment would be realized.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects in the present invention, reference should be had to the following detailed description taken in connection with the accompanying drawings, in which.

Figure 10:
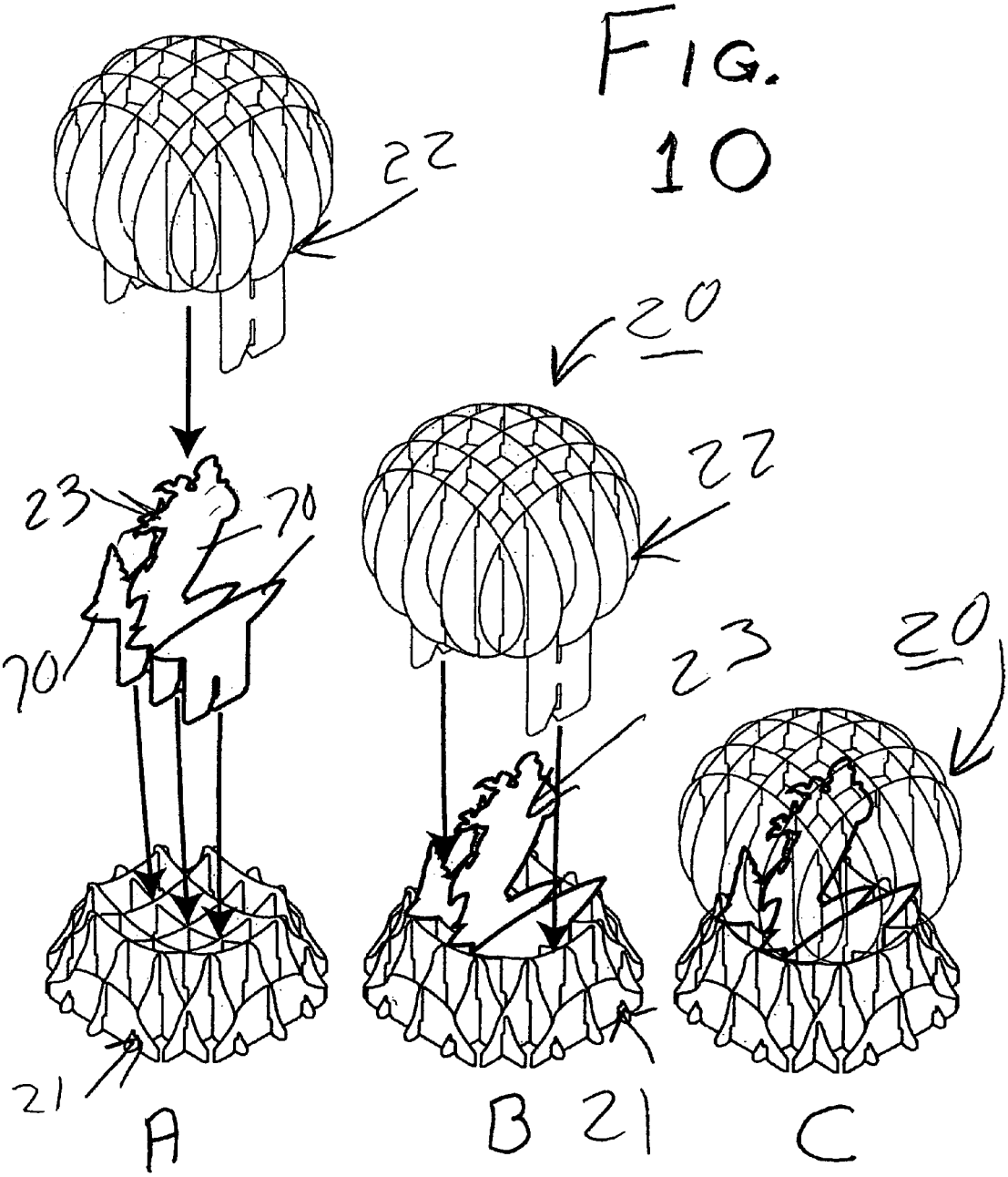
Figure 11:
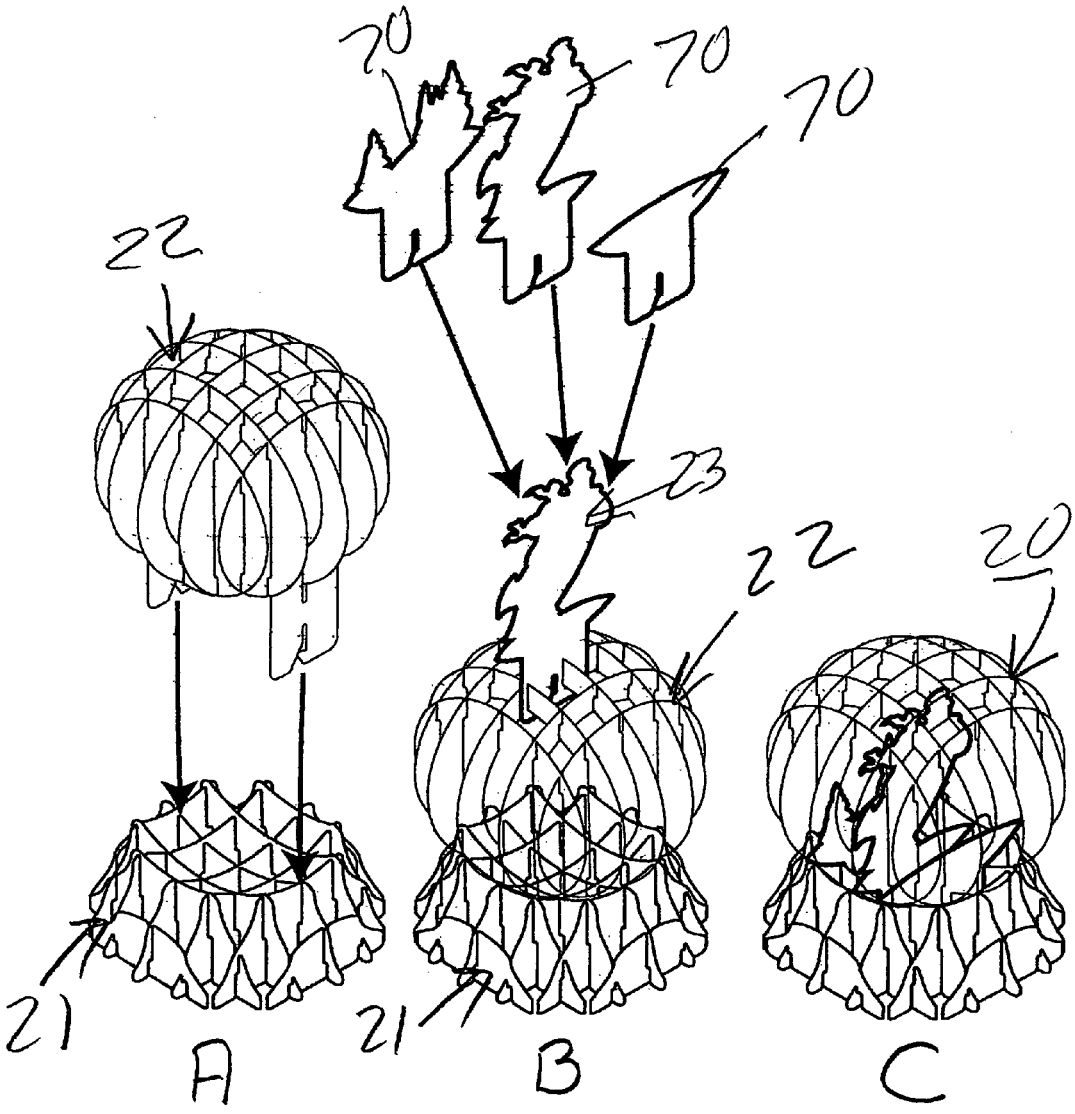
Figure 12:
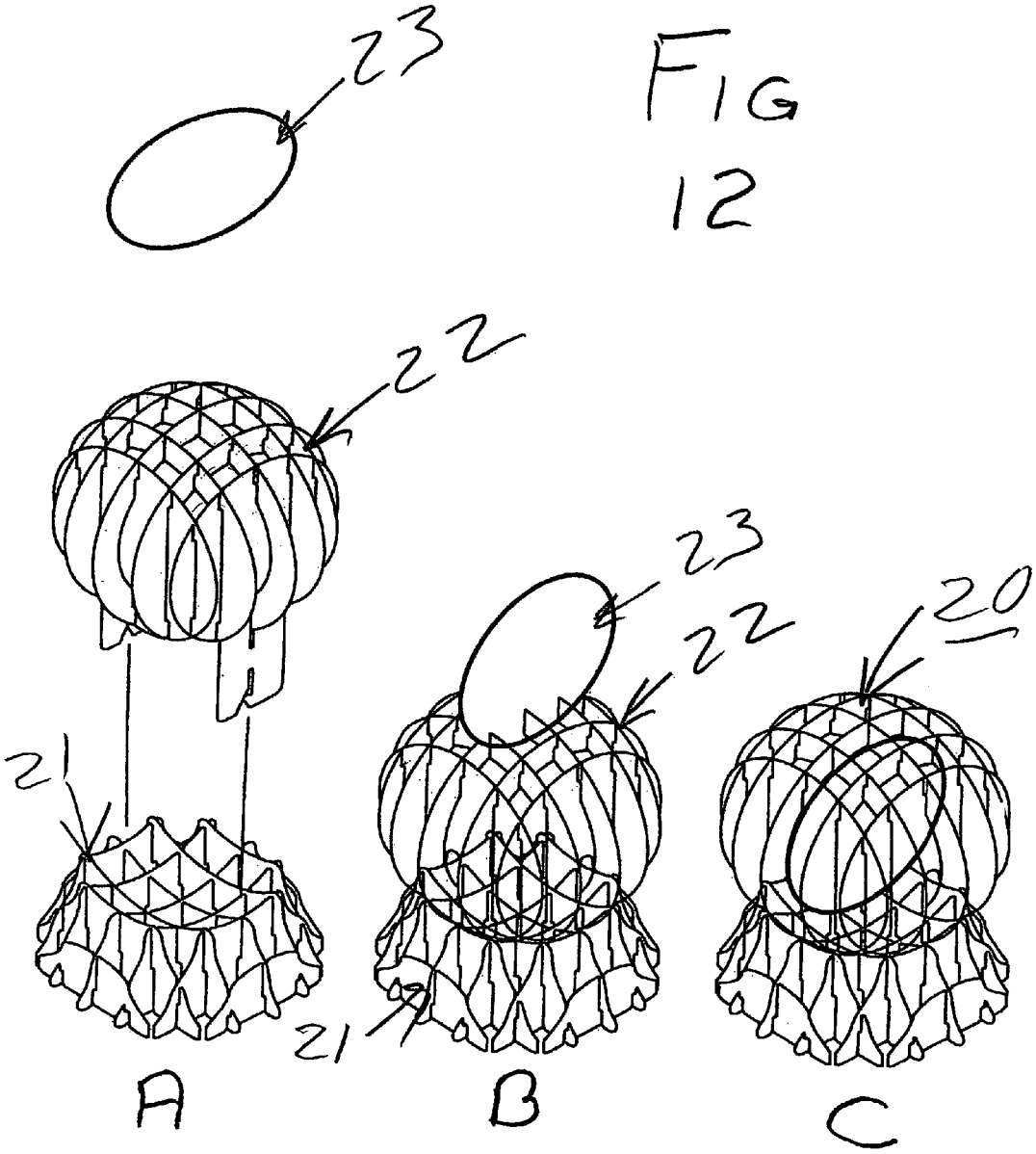
Figure 13:
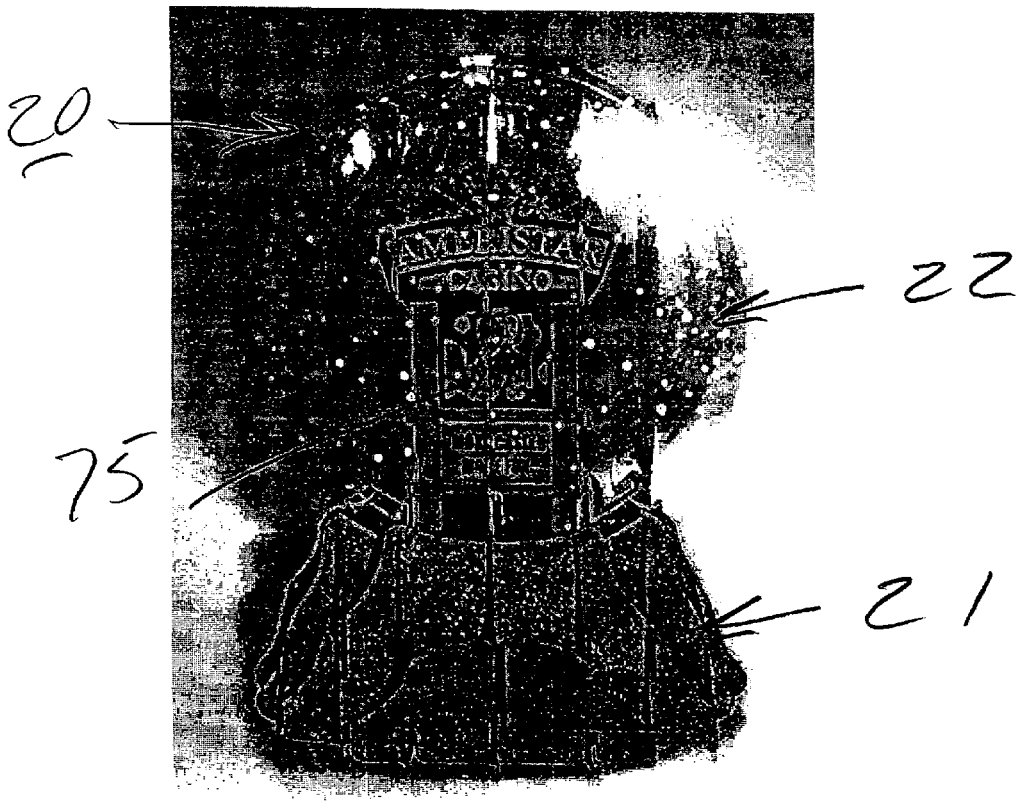
Figure 14:
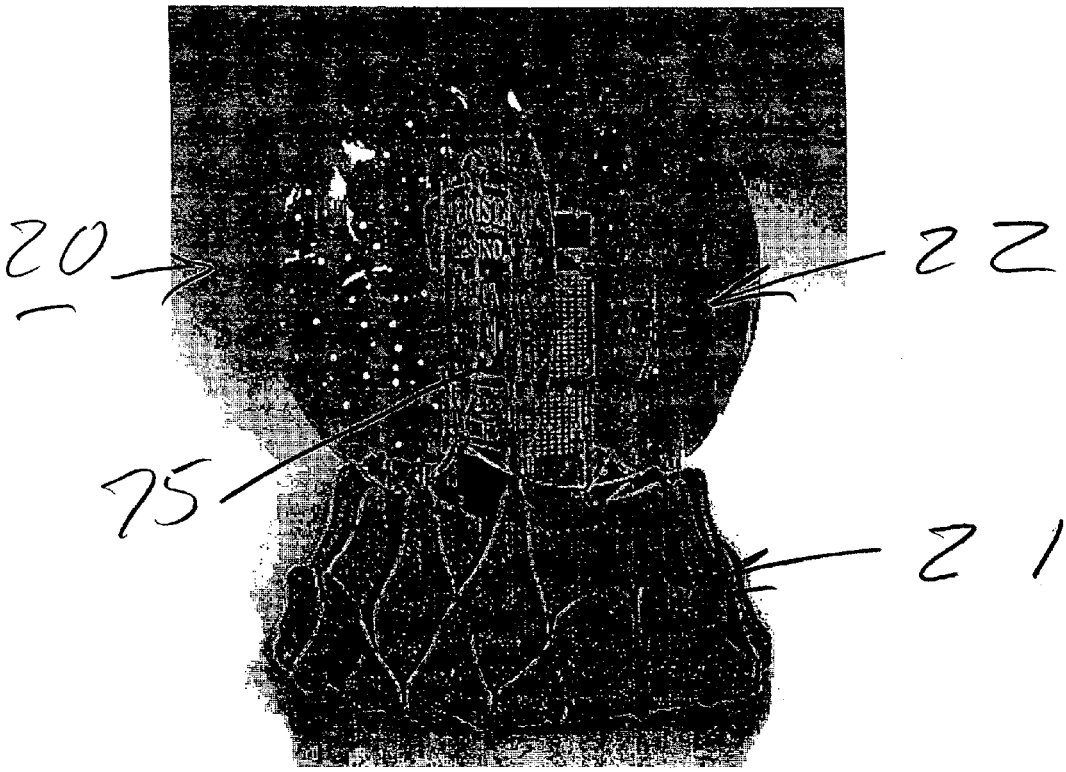
Figure 15:
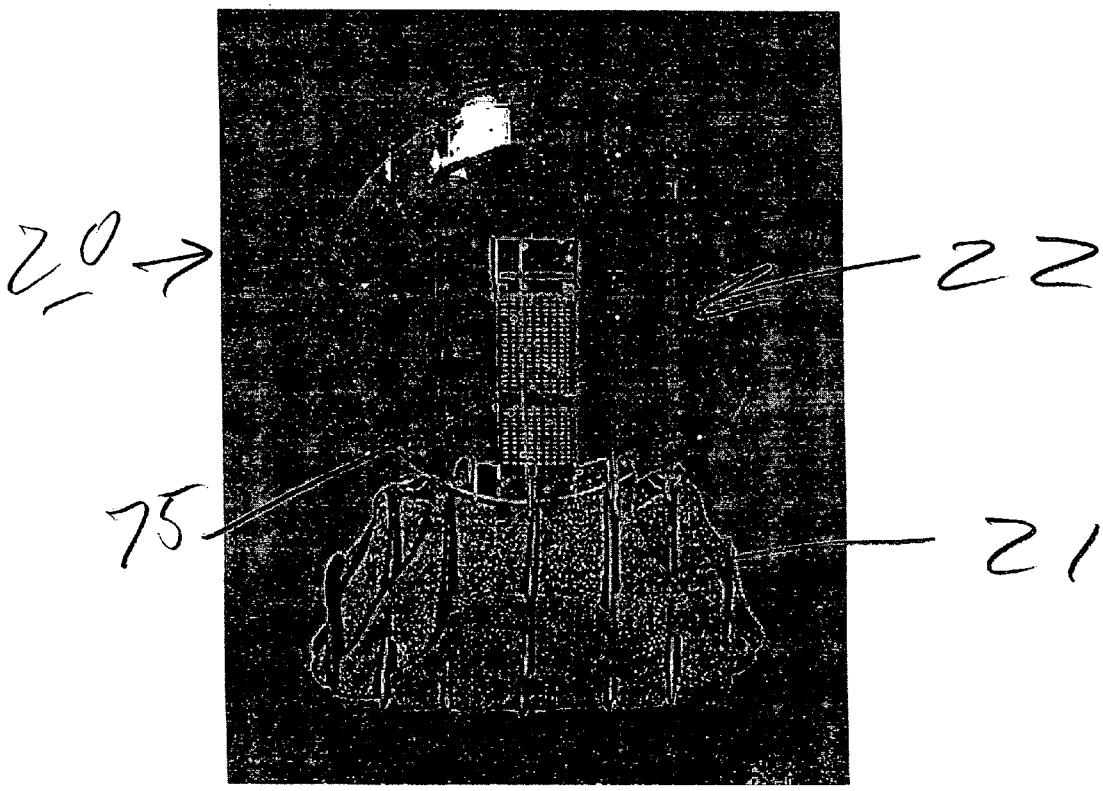
Figure 16:
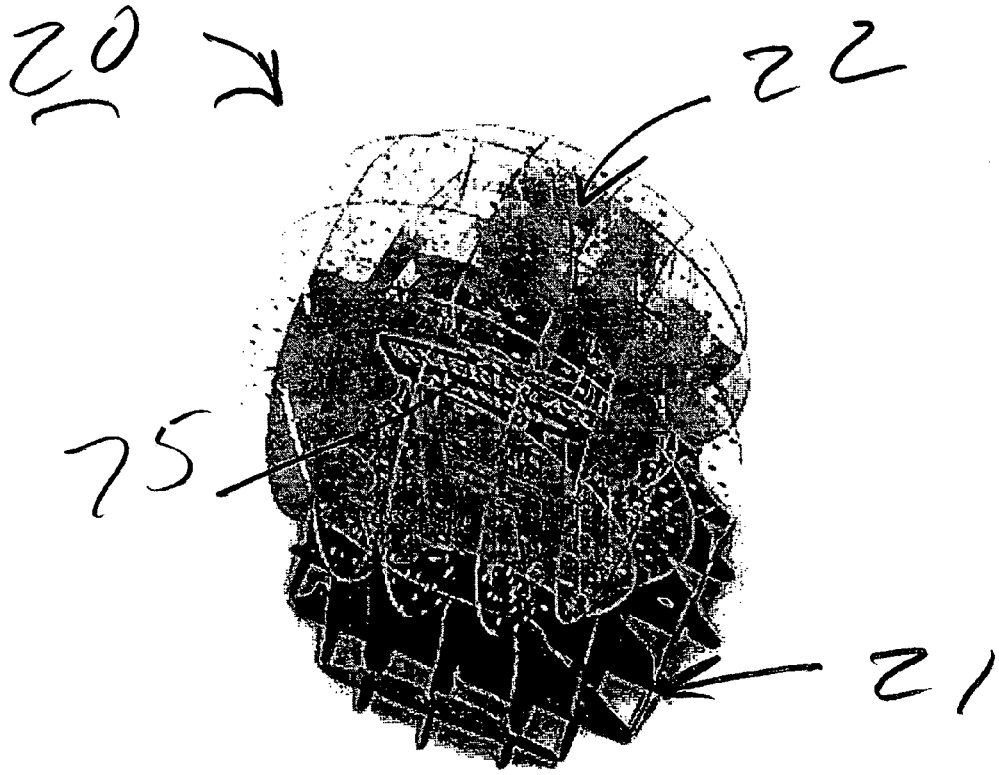
Figure 17:
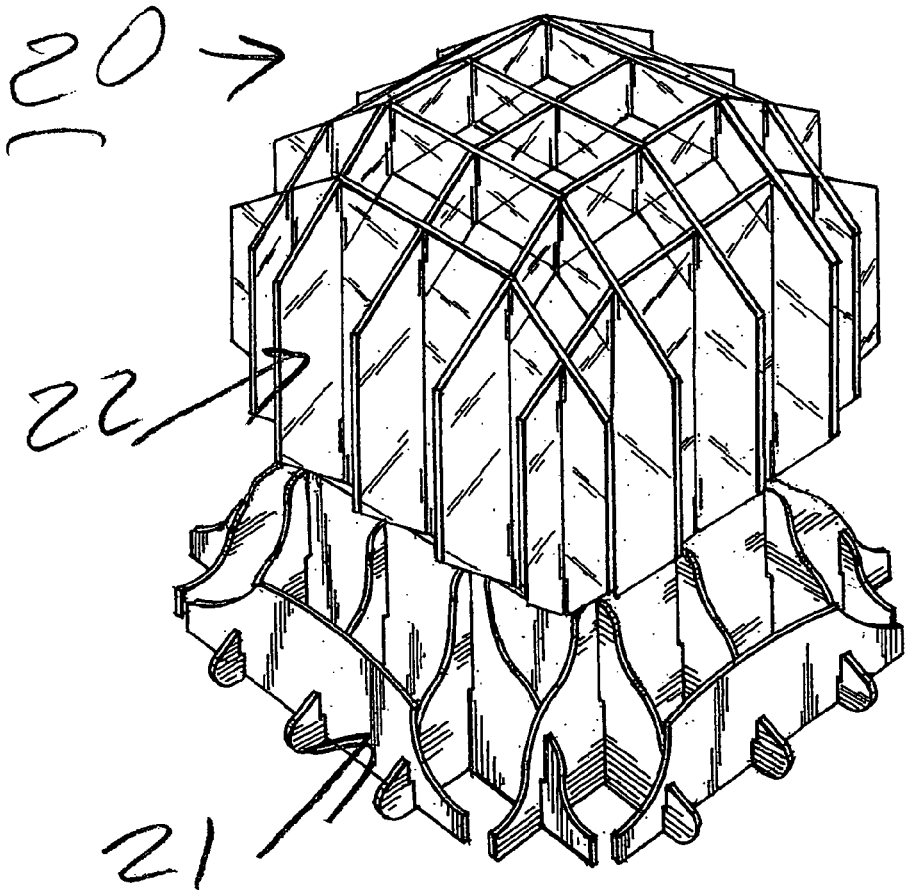
Figure 18:
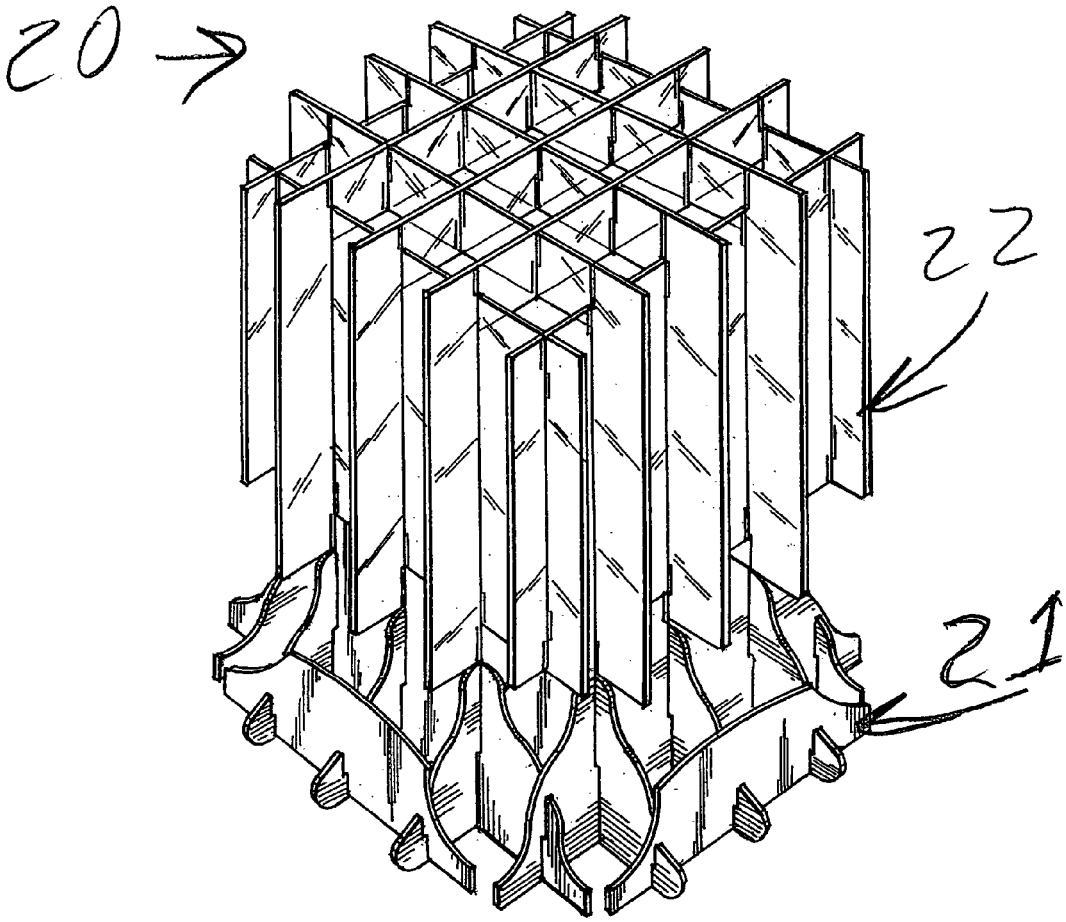
Figure 19:
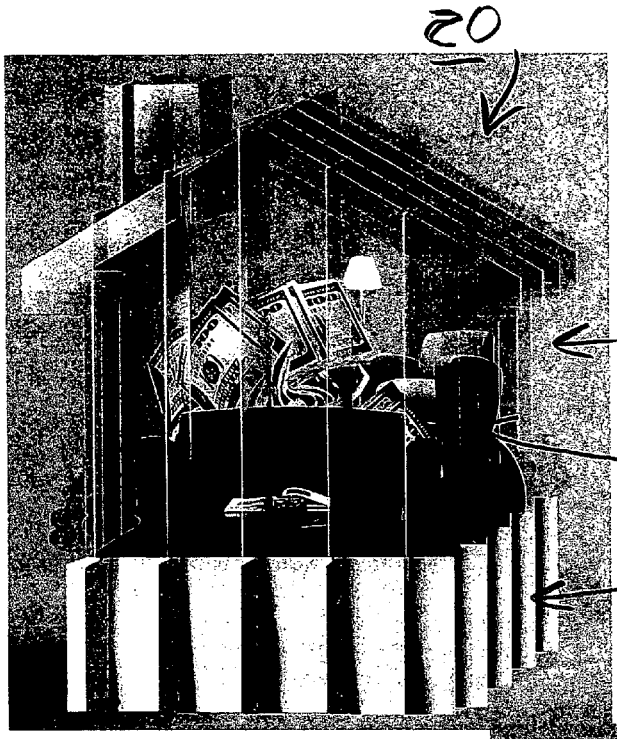
Figure 20:
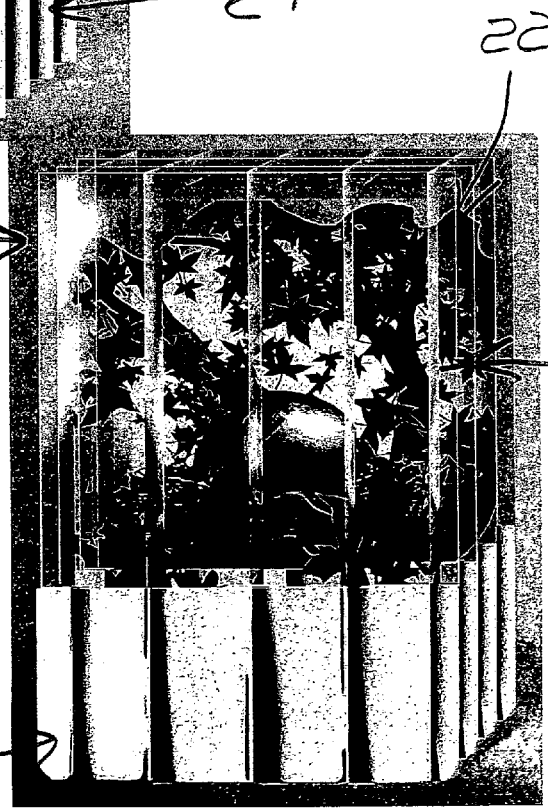
Figure 21:
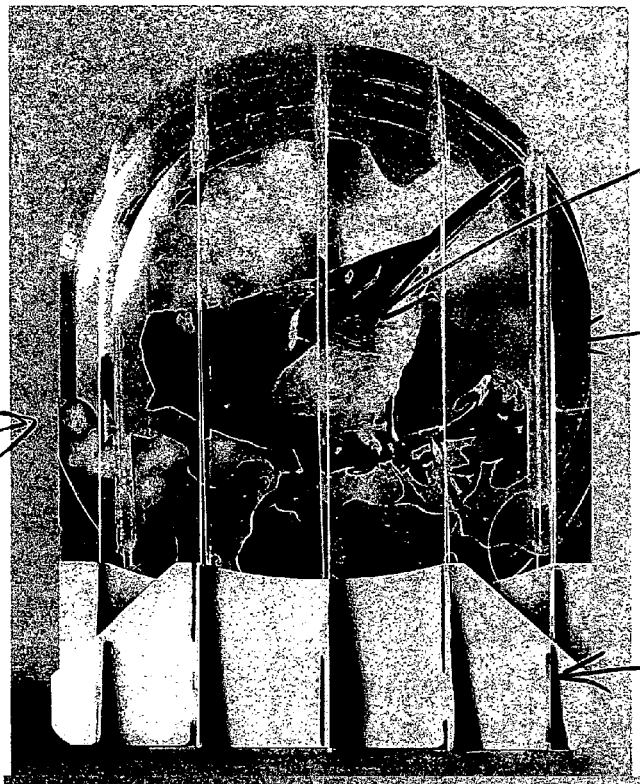
Figure 22:
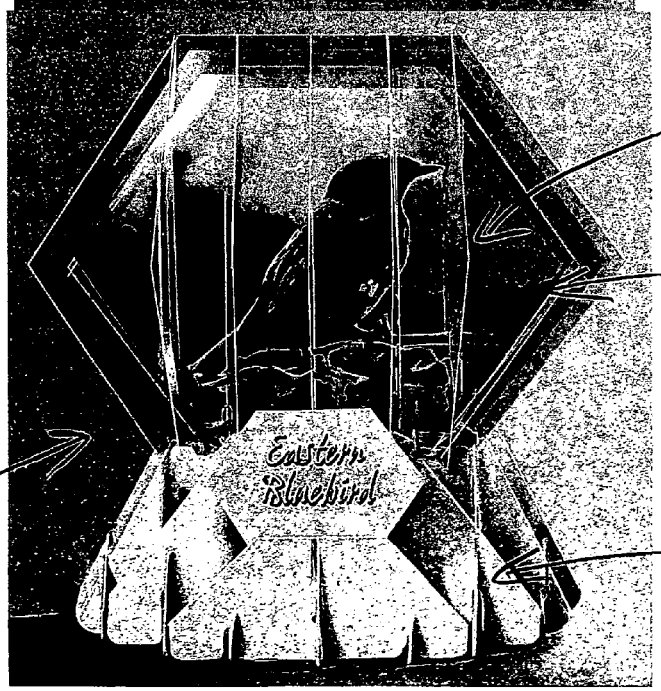
Figure 23:
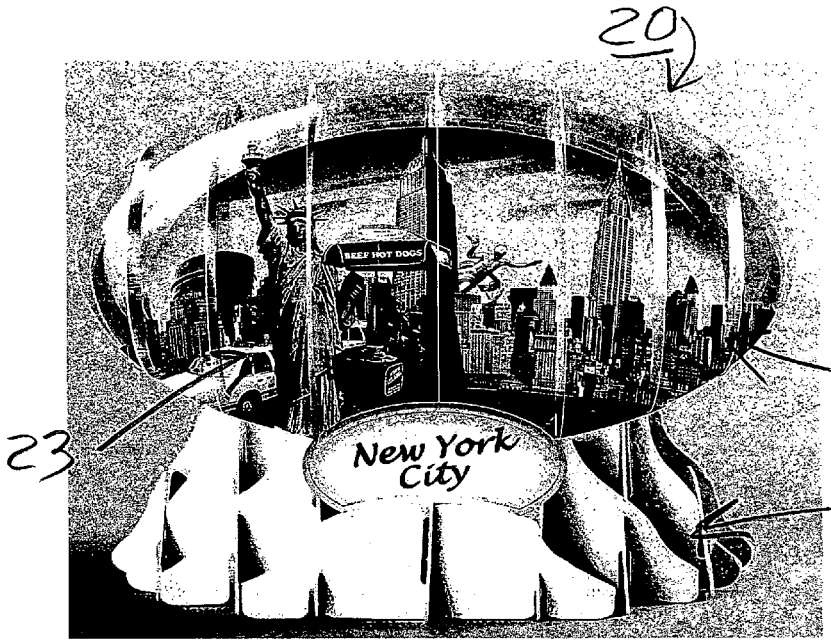
Figure 24:
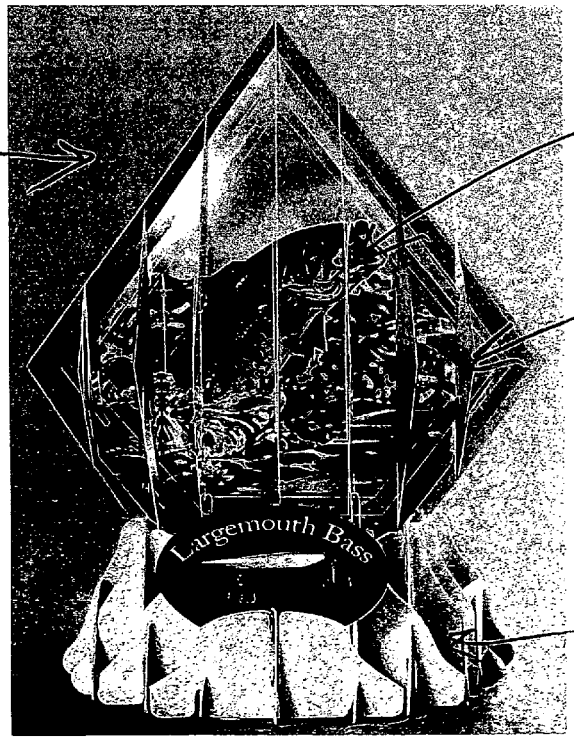
Figure 25:
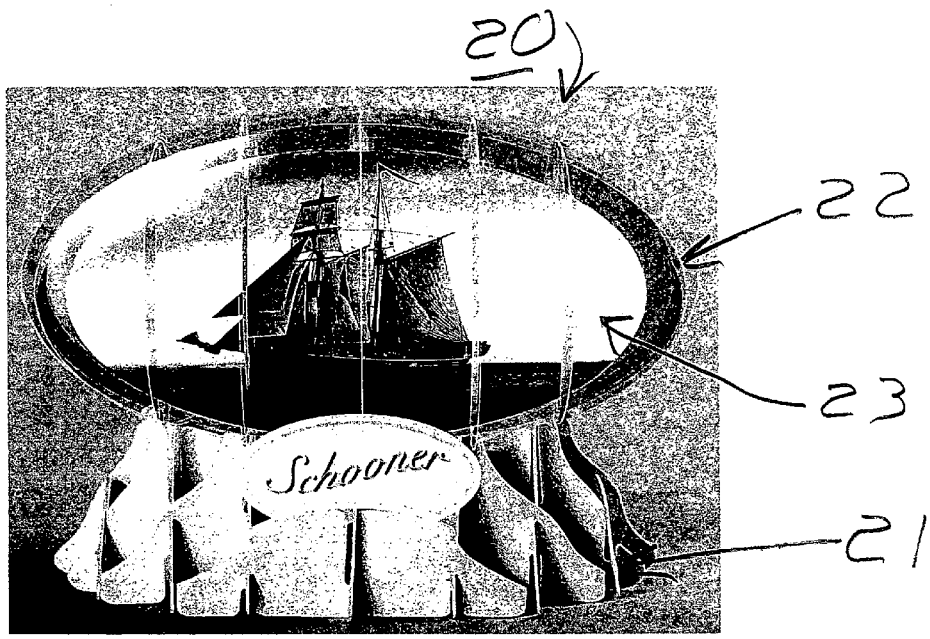
Figure 26:
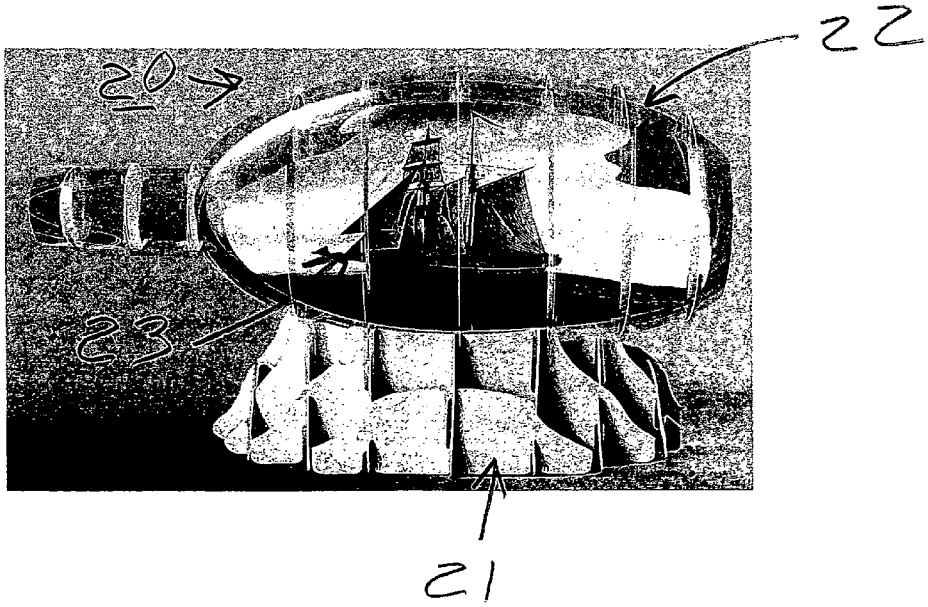
Figure 27:
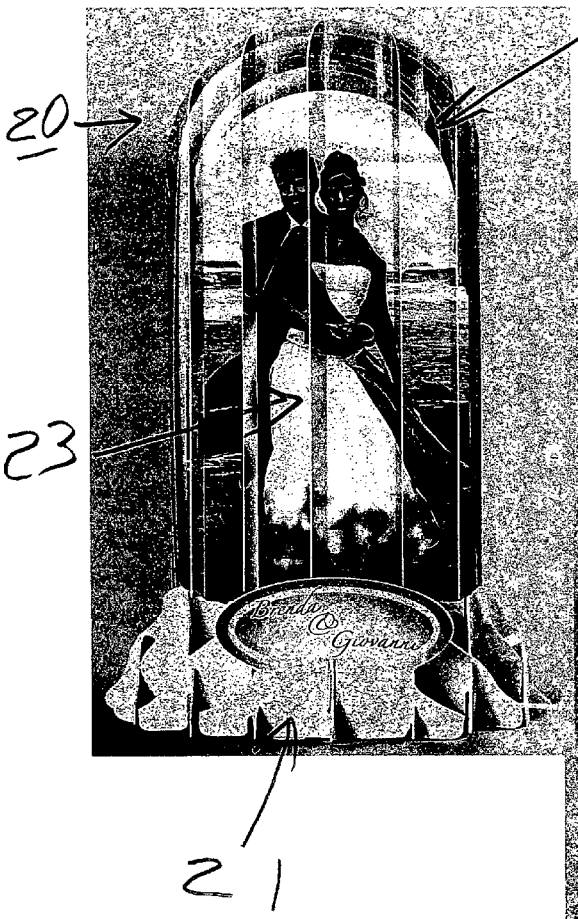
Figure 28:
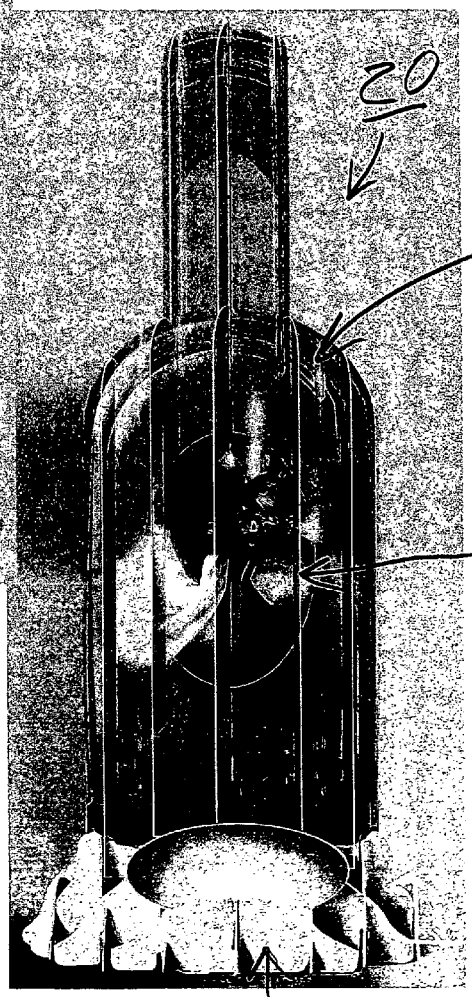
Figure 29:
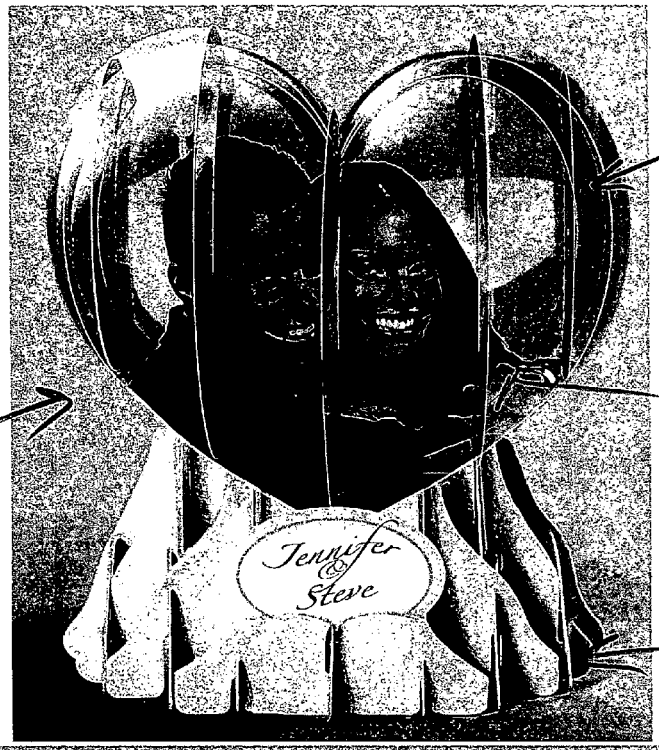

FIG. 10 comprises perspective views A, B, and C depicting the display member/portion in the process of being assembled with the display or feature element to the support base for forming the three-dimensional display system of the present invention;

FIG. 11 comprises perspective views A, B, and C depicting an alternate embodiment for assembling the three-dimensional display system of the present invention;

FIG. 12 comprises perspective views A, B, and C depicting a further alternate embodiment for assembling the three-dimensional display system of the present invention incorporating an alternate display or feature element;

FIG. 13 is a front elevation view of a further alternate embodiment of the three-dimensional display system of the present invention with the display or feature element comprising a foldable three-dimensional building or structure;

FIG. 14 is an angular side elevation view of the three-dimensional display system of FIG. 13;

FIG. 15 is a side elevation view of the three-dimensional display system of FIG. 13;

FIG. 16 is a top perspective view of the three-dimensional display system of FIG. 13;

FIG. 17 is a perspective view of a further alternate embodiment of the three-dimensional display system of the present invention wherein the display member or portion thereof comprises a polygonal shape;

FIG. 18 is a perspective view of a still further alternate embodiment of the three-dimensional display system of the present invention wherein the display member or portion thereof comprises a square or rectangular shape; and FIGS. 19-35 are perspective views of still further alternate embodiments of the three dimensional display system of the present invention.

DETAILED DISCLOSURE

By referring to FIGS. 1-35, along with the following detailed discussion, the preferred constructions and operation of a plurality of alternate embodiments of the present invention can best be understood. In each of these embodiments, foldable, three-dimensional display system 20 is fully disclosed which is capable of being easily moved between a substantially flat configuration into a fully erect, three-dimensional configuration.

Although this disclosure and the associated drawings fully detail several alternate preferred embodiments of the present invention, further alternate embodiments can be implemented without departing from the scope of this invention. Consequently, it is to be understood that the following disclosure is provided for exemplary purposes only and is not intended as a limitation of the present invention. Furthermore, all alternate embodiments which are obvious modifications of this disclosure are intended to be encompassed within the scope of the present invention.

Figure 1:
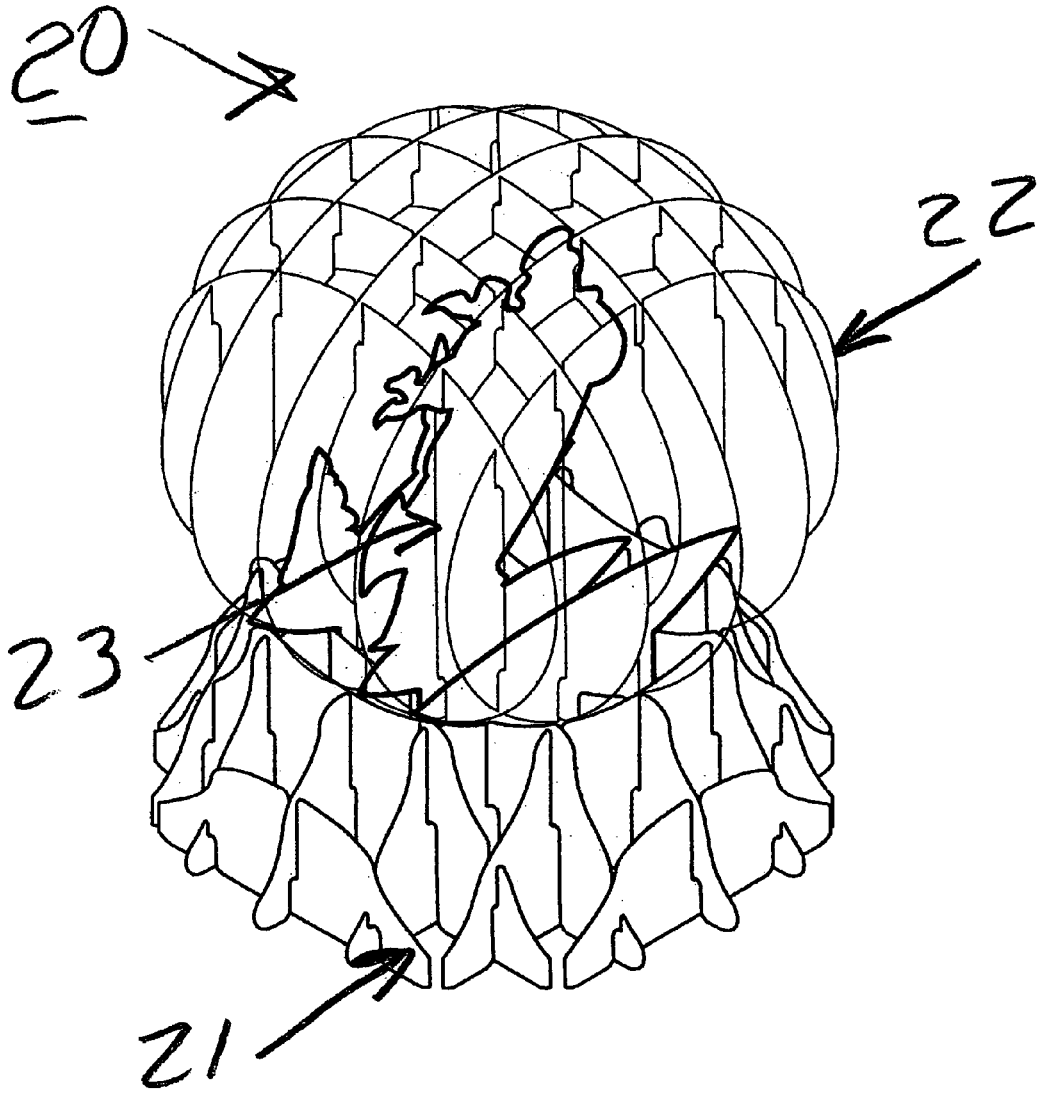
FIG. 1 is a perspective view of the foldable, three-dimensional display system made in accordance with the present invention as shown in its erect, fully displayed position.

In FIG. 1, foldable, three-dimensional display system 20 of the present invention is depicted in one preferred embodiment, wherein display member or portion 22 is constructed as spherically shaped, globe mounted on supporting base portion 21. In addition, in this embodiment, display or feature element 23 is in the form of pre-printed, cut out figures and elements centrally mounted in display portion 22.

As fully detailed below, both display member/portion 22 and supporting base portion 21 are constructed from a plurality of separate and independent, substantially flat panel members, each of which are mounted in interlocked interengagement with each other, to form the desired component. In addition, by employing this construction, each of these components is capable of being easily folded between a fully displayed, three-dimensional configuration and a substantially flat, planar configuration.

Furthermore, any desired display or feature element 23 may be mounted in display member/portion 22 for providing the desired visual effect. In this regard, display element 23 may comprise any form, shape, configuration, photograph, logo, panel, color, etc. which is desired by the manufacturer of display system 20 or by the customer for whom display system 20 is created. In addition, by employing the present invention, display element 23 can be in a flat, planar, two dimensional configuration, or can be a three-dimensional element having any desired size or shape. However, regardless of the form or configuration of display element 23, the present invention provides an easily constructed foldable three-dimensional display system 20 which is capable of being produced economically in order to provide users with a display system which provides all of the visual aesthetics and enhancements desired, in a cost effective manner.

Figure 2:
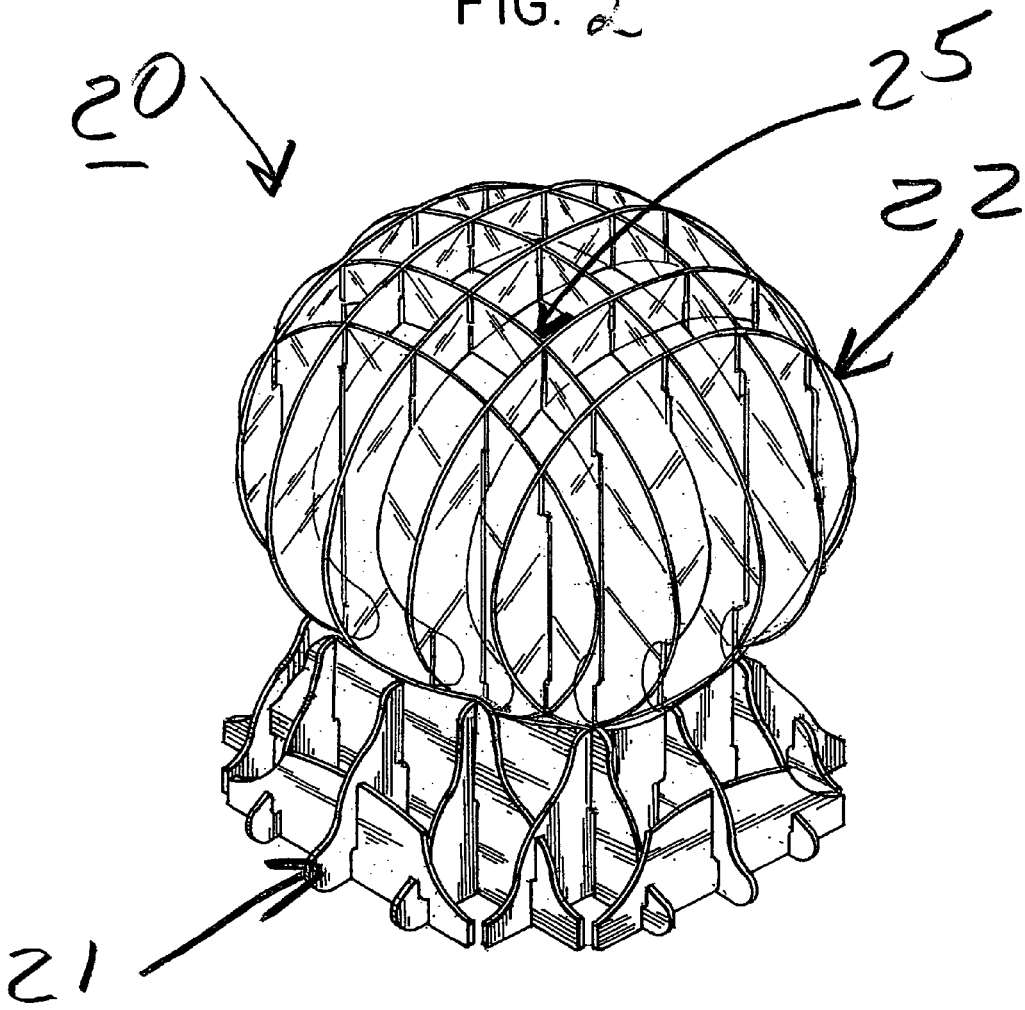
FIG. 2 is a perspective view of the foldable, three-dimensional display system of the present invention shown in its erect, fully displayed position with the display or feature element removed therefrom.
Figure 3:
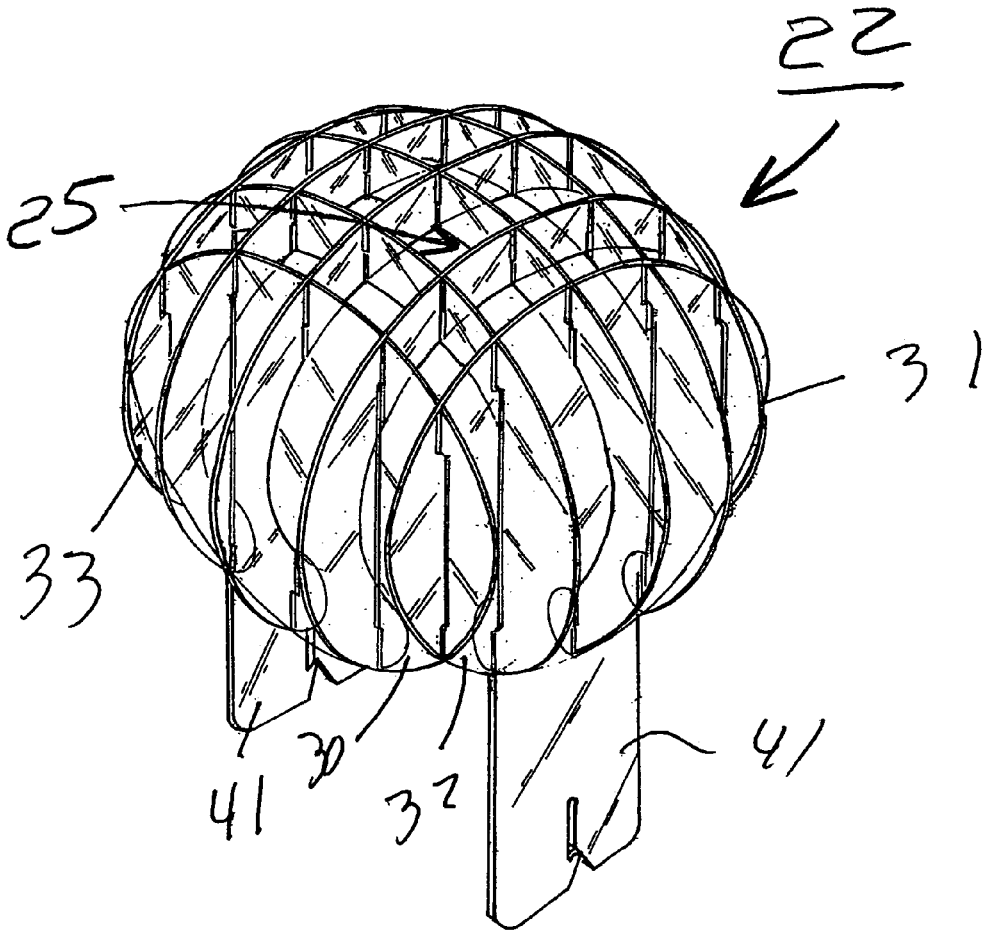
FIG. 3 is a top perspective view of the display member/portion of the three-dimensional display system of FIG. 2 and depicted removed therefrom.
Figure 4:
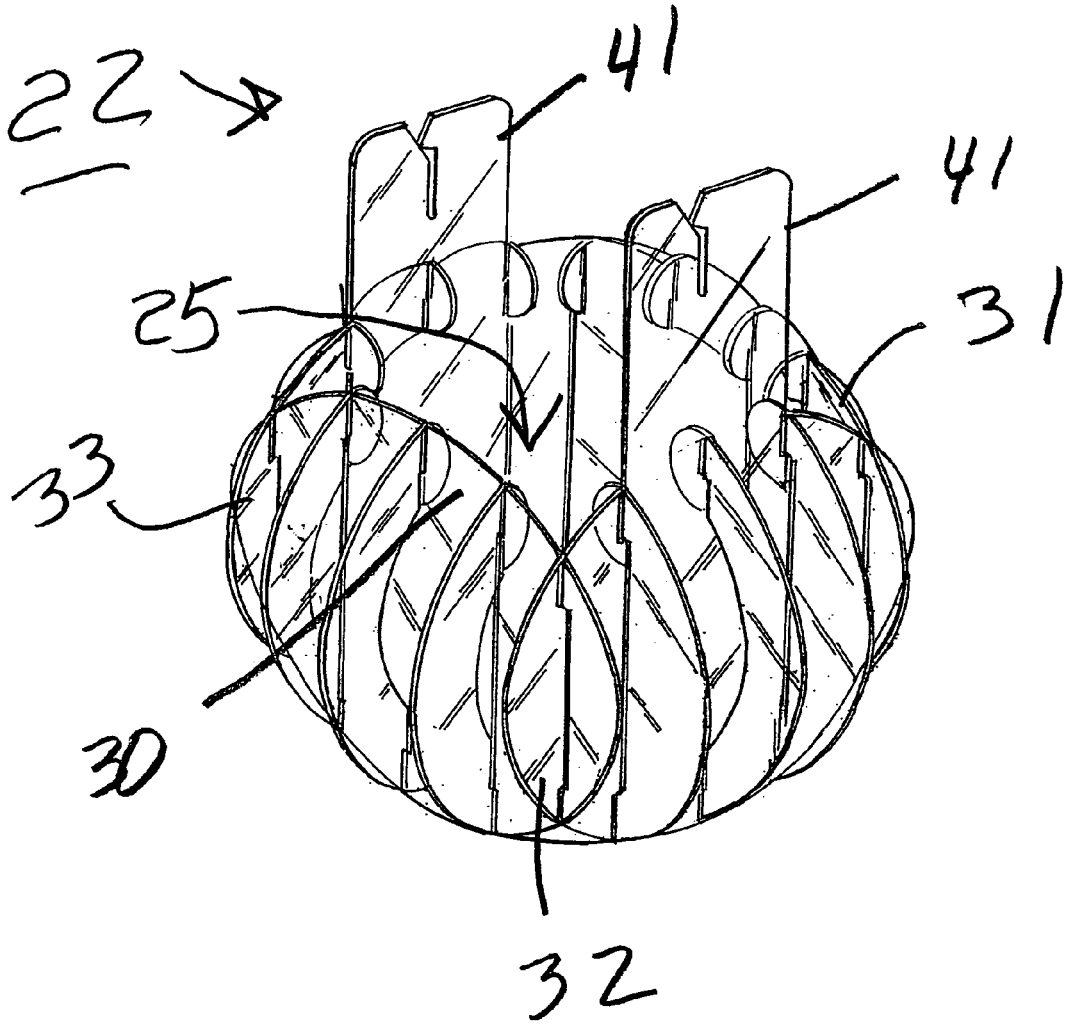
FIG. 4 is a bottom perspective view of the display member/portion of the three-dimensional display system of FIG. 3.

In FIG. 2, foldable, three-dimensional display system 20 is depicted with display element 23 removed while FIGS. 3 and 4 depict the top and bottom views of display portion 22 of three-dimensional display system 20. By referring to these figures, along with FIG. 5 and the detailed discussion herein provided, the unique construction and operation of display portion 22 of the present invention can best be understood.

As shown in these figures, display portion 22 preferably comprises a plurality of panel members 30, 31, 32, 33, 34, 35, 36, 37, 38, and 39, which are lockingly mounted in interengagement with each other. As fully detailed herein, the preferred construction effectively creates display portion 22 with any desired overall shape, along with a centrally formed cavity 25 defined by and peripherally surrounded by panel members 30-39. By employing this construction, display system 20 is easily constructed with any desired display element 23 mounted therein.

Figure 5:
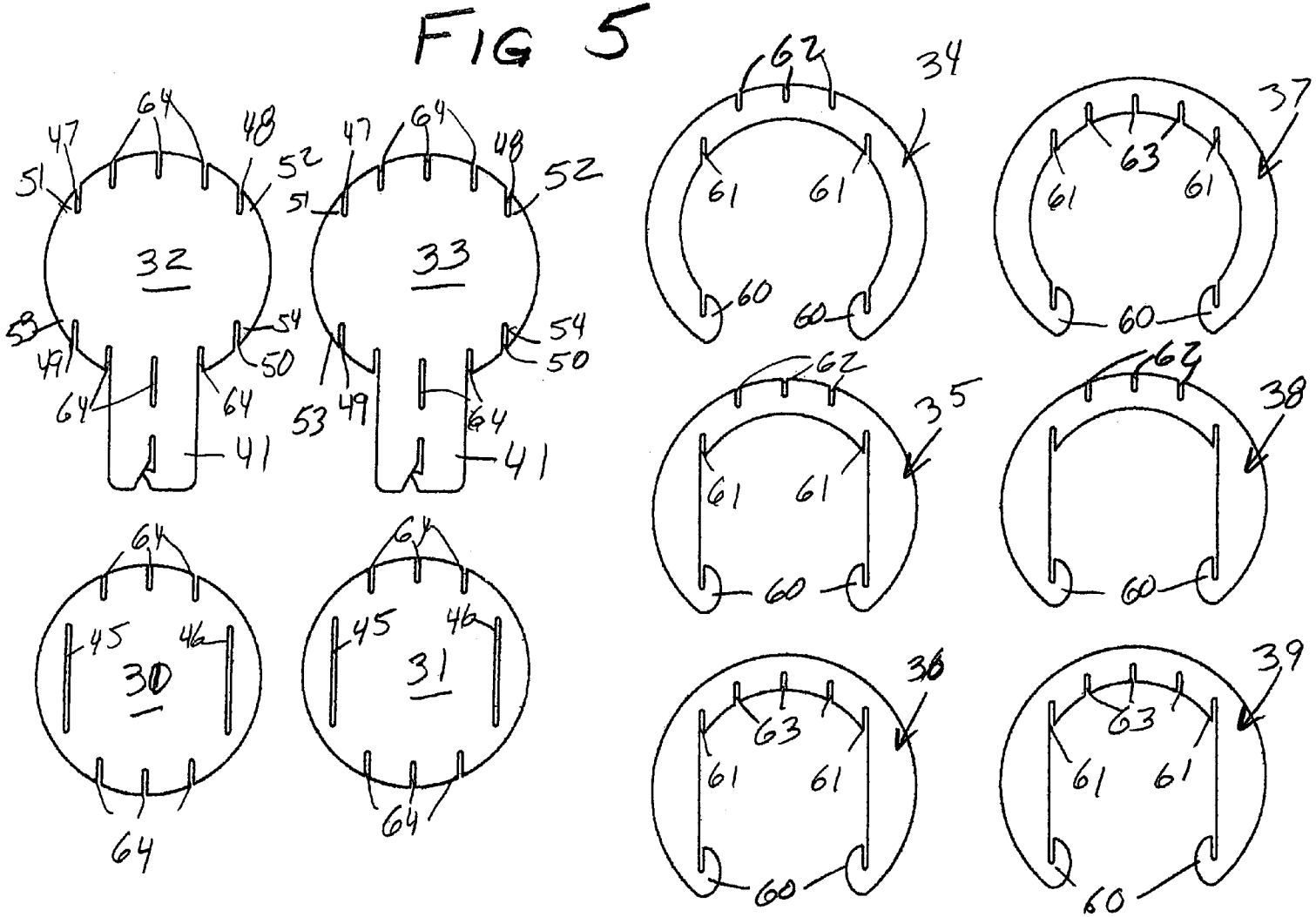
FIG. 5 is a plan view depicting each of the panels members forming the display member/portion of the display system of the present invention.

In FIG. 5, the plurality of panel members 30-39 employed to form display member/portion 22 are fully depicted in a completely disassembled configuration, while also being shown in a fully assembled configuration in FIGS. 3 and 4. In the embodiment depicted, display member/portion 22 comprises an overall spherical shape, incorporating central void zone or cavity 25 for receiving and retaining any desired display element 23. Although display portion 22 is depicted in a spherical shape, any desired shape can be employed, as detailed below.

In the preferred construction, panel members 30 and 31 comprise substantially circular shapes and effectively form the front and rear surface of display member 22. In addition, panels 32 and 33 comprise circular shaped portions and are employed to form the sides of display member 22. Preferably, panels 32 and 33 also incorporate locking arms 41 extending from the bottom edge of the circular-shaped panel portion, with arms 41 being constructed for locking engagement with base 21. In the preferred constructions, arms 41 extend downwardly from the base of panels 32 and 33 and incorporate a construction for mating, interlocking interengagement with base portion 21. In this way, display member/portion 22 is quickly and easy securely mounted to base portion 21 and maintained in locked interengagement therewith.

If desired, display member/portion 22 may also incorporate locking zones incorporated within cavity 25 or cooperating with cavity 25 which enables display element 23 to be easily secure in the desired position within cavity 25. In this way, the overall construction and assembly of display system 20 is enhanced. Alternatively, as detailed below, display element 23 is affixed to base portion 21 for being maintained in position for display in cavity 25.

In order to attain the desired unique construction for display member/portion 22, panel members 30-39 are each constructed for being lockingly interconnected with each other. In this regard, FIG. 5 fully details the preferred configuration of each-panel member, as well as the preferred slot positions and arrangement which have been found to achieve the desired construction. However, although the specific detailed construction shown in FIG. 5 is preferred, alternate constructions and variations may be implemented without departing from the scope of the invention.

The principal unique feature provided by the present invention is the creation of a foldable display member/portion 22 which defines a desired overall shape, such as a sphere or globe, and incorporates central cavity 25, which is formed therein and is peripherally surrounded and defined by panel members 30-39. As a result of this construction, display system 20 is easily assembled with any desired display or feature elements 23 mounted therein.

In the preferred embodiment, panel members 30-39 each comprise a plurality of slots or slits formed therein which are specifically positioned for enabling panel members 30-39 to be quickly and easily assembled together in locked interengagement. In this regard, the mating slits and slots formed in panels 30, 31, 32, and 33 are of particular importance by establishing the overall structure of display member/portion 22 and cavity 25.

As shown in FIG. 5, panels 30 and 31 each comprise a pair of slits 45 and 46 formed therein in juxtaposed, spaced, parallel relationship to each other. In addition, panels 32 and 33 each comprise slits 47 and 48 formed in the front and rear of the top edge of the circular portion thereof, while also comprising slits 49 and 50 formed in the lower edge thereof. By employing this construction, upper tabs 51 and 52 are formed in panels 32 and 33 along with lower tabs 53 and 54.

In order to establish the basic structure of display member/portion 22, panels 30, 31, 32 and 33 are assembled. In achieving this result, tabs 51 and 53 of panel 32 are inserted into slit 45 of panel 30. Where necessary, tabs 51 and 53 are arcuately bent or flexed to achieve the desired engagement. Once mounted in position, tabs 51 and 53 abut the outer surface of panel 30, with slits 47 and 49 engaged with panel 30 at the opposed ends of slot 45.

By following the identical procedure detailed above, tabs 52 and 54 of panel 30 are inserted into slit 45 of panel 31 and lockingly engaged therein. Thereafter, panel 33 is mounted to panels 30 and 31 by following this identical procedure to engage tabs 51 and 53 in slot 46 of panel 30 and then engage tabs 52 and 54 in slot 46 of panel 31. Once this process is completed, the basic structure of display member/portion 22 is established with internal cavity 25 integrally formed therewith.

In order to complete the construction of display member/portion 22, panel members 34-39 are mounted to pre-assembled panel members 30-33. As shown, each panel member 34-39 comprises a generally horseshoe shape along with locking fingers 60 being formed at each end thereof. In addition, each panel member 34-39 incorporates slits 61 formed on the inside edge of the upper portion thereof, positioned for enabling locking fingers 60 and slits 61 of each panel member to be easily mounted to panels 30-33.

Finally, in the preferred embodiment, panel members 34, 35, and 38 incorporate slits 62 formed in the top edge of the upper portion thereof between slits 61, while panel members 36, 37, and 39 incorporate slits 63 formed in the lower edge of the upper portion thereof between slits 61. By interengaging slits 62 and 63 with each other while also securing panels 34-39 with pre-assembled panels 30-33, the fully assembled display member/portion 22 is attained. In order to assure assembly ease and alignment, panel members 30-33 incoprorate slits 64 formed therein for receiving panels 34-39. In addition, due to the horseshoe construction of panel members 34-39, internal cavity 25 is fully established and the precisely desired, fully constructed display member 27 is realized.

By employing panel members 30-39 as detailed above, an easily constructed, foldable, spherically-shaped display member/portion 22 is realized. However, as is more fully detailed below, display member/portion 22 may be constructed in a plurality of alternate sizes and shapes without departing from the scope of this invention. Consequently, it is important to recognize that the size, shape, or appearance of display member/portion 22 may be widely varied or altered. However, regardless of the configuration employed, internal cavity 25 must be present to achieve the unique attributes of the present invention.

Figure 7:
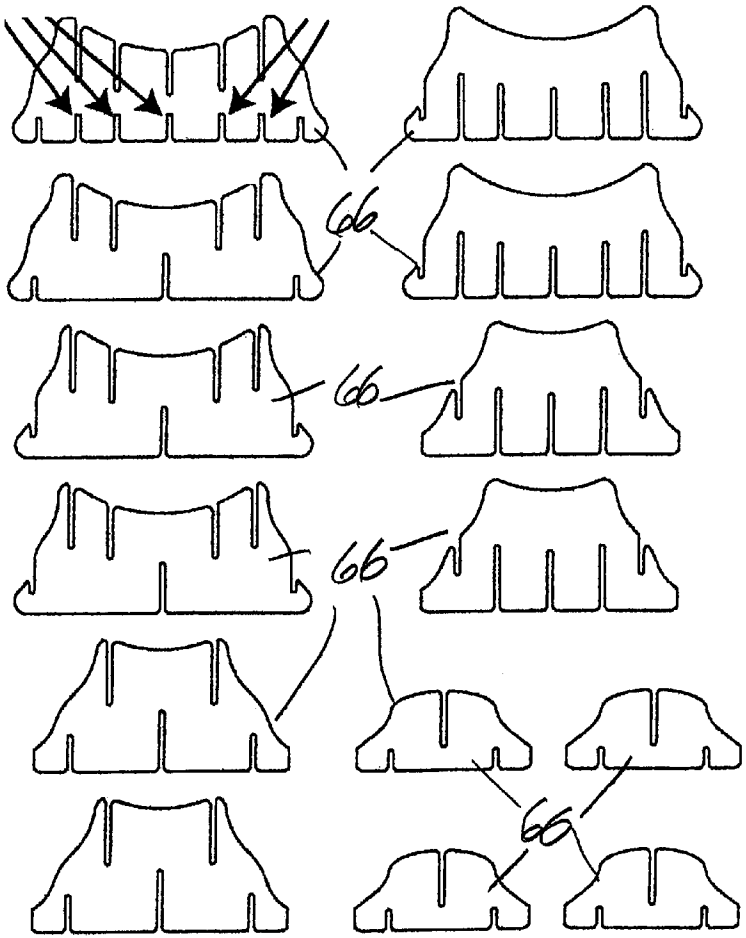
FIG. 7 is a plan view depicting the panel members forming the base portion of the display system of the present invention.
Figure 6:
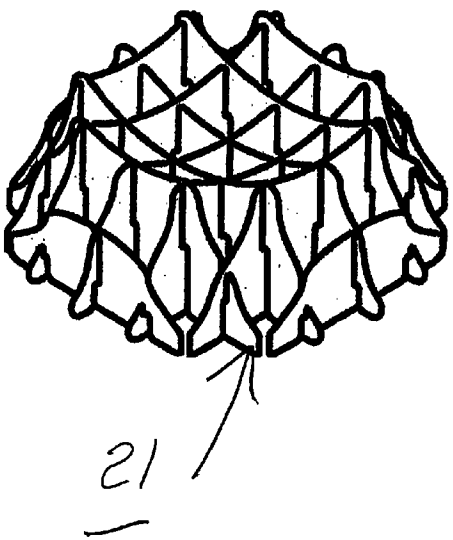
FIG. 6 is a top perspective view of the base portion of the three-dimensional display system of the present invention and shown removed therefrom.

In FIG. 6, base portion 21 is depicted in a fully assembled configuration, while FIG. 7 depicts base portion 21 completely disassembled. In this regard, FIG. 7 displays each of the panel members 66 employed to form base portion 21, with each panel member 66 being shown with a plurality of slots positioned for locking interengagement with each other to achieve the desired base portion construction and configuration. By employing this construction, the desired foldable configuration is realized, wherein base portion 21 is capable of being folded into a substantially flat configuration, as well as quickly and easily moved into a three-dimensional configuration.

If desired, base portion 21 may also incorporate locking zones or notches formed therein for cooperating with display element 23, in order to assure the secure, locked interengagement of display element 23 therewith. Whether base portion 21 and/or display zone/portion 22 incorporate locking elements for engaging with the display element 23, the overall construction achieved by this invention assures that display system 20 is quickly and easily assembled into a final construction, incorporating any desired display element 23 securely positioned and retained therein.

By employing this construction and securely affixing display element 22 to display zone portion 22 and/or base portion 21, easy, rapid assembly of display system 20 is realized, without requiring cumbersome gluing or other affixation methods. As a result, an easily produced display system 20 is realized, further enhancing its manufacture, use and enjoyment.

Another unique aspect of the present invention is the creation of the display potion of the overall assembly in a standardized configuration for all different products. In this regard, in the globe or spherical display embodiment, each spherical globe display member is constructed from a plurality of separate panel members interlocked with each other to form a central opening or cavity, as fully detailed above.

Figure 8:
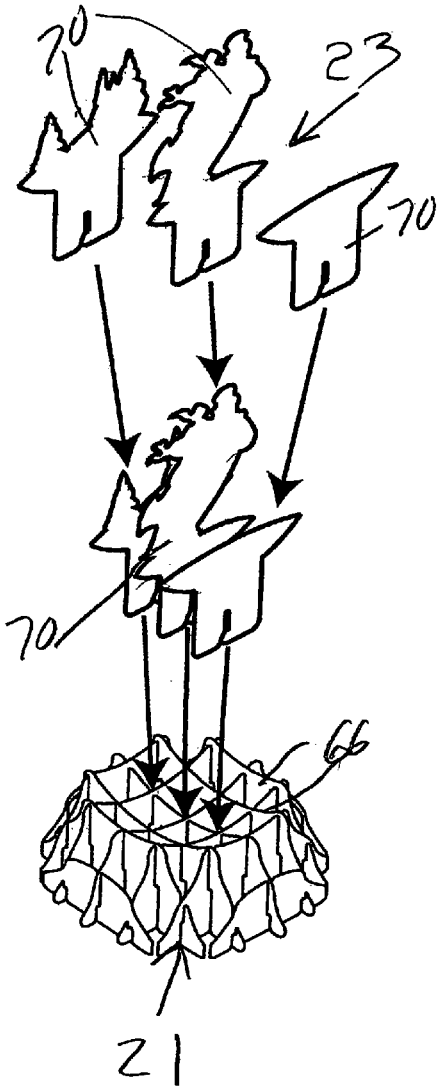
FIG. 8 is an exploded perspective view of one embodiment of a display or feature element being assembled and mounted to the base portion.
Figure 9:
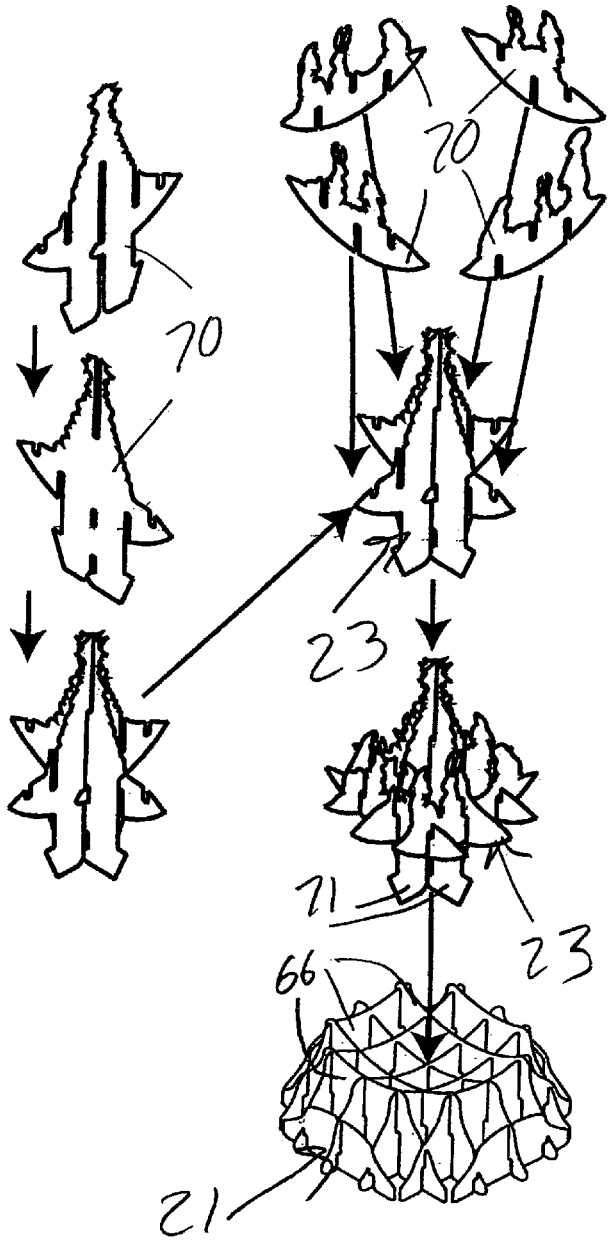
FIG. 9 is an exploded perspective view showing an alternate embodiment of a display or feature element being assembled and mounted to the base portion.

By referring to FIGS. 8 and 9, two alternate constructions for display or feature element 23, and the secure mounting of feature element 23 to base 21, are clearly shown. In this regard, in FIG. 8, three separate and independent display panels 70 form display/feature element 23, with each display panel 70 being slidably engaged and lockingly interconnected to independent panel members 66 which form base portion 21. By employing this simple, straightforward construction, foldable, three-dimensional display system 20 is quickly and easily assembled.

In addition, in FIG. 9, display/feature element 23 is depicted in a more complex construction, comprising a plurality of display panels 70 forming display/feature element 23. By lockingly engaging display panels 70 with each other, the desired display/feature element 23 is achieved. Once constructed, locking arms 71 extending from the constructed display/feature element 23 are employed for being inserted into base portion 21 and lockingly engaged therewith. By employing this construction, a more detailed, complex display/feature element 23 is achieved, while also providing a display element 23 which is quickly and easily assembled and securely mounted to base portion 21 for forming the three-dimensional display system 20 of the present convention.

In order to best understand the overall construction of foldable, three-dimensional display system 20, reference should be made to FIG. 10, which comprises views A, B, and C, wherein display zone/portion 22 is shown being inserted and lockingly engaged with display/feature element 23 after being mounted to support base 21. As detailed above, since display zone/portion 22 incorporates internal cavity 25, display element 23 is positioned and first lockingly mounted to base portion 21. Thereafter, display zone/portion 22 is telescopically advanced into locked interengagement with base portion 21, with display element 23 being aligned for entry into cavity 25 of display zone/portion 22, as display zone/portion 22 is securely mounted to base portion 21. Once display zone/portion 22 is securely mounted to base portion 21, the entire construction of three-dimensional display system 20 is completed.

By referring to FIG. 11, which also comprises views A, B, and C, an alternate embodiment for constructing foldable, three-dimensional display system 20 is depicted. In this alternate embodiment, the rapid, easy assembly of foldable, three-dimensional display system 20 is attained by first mounting and lockingly securing display member/portion 22 directly to base portion 21. Once display member/portion 22 is secured in position, panels 70 forming display/feature element 23 are inserted through openings formed in panels 30-39 which form display member/portion 22.

In this construction, specific panels 30-39 of display member/portion 22 are constructed in a manner which enables panels 70 forming display/feature element 23 to be slidingly inserted through panels 30-39 into cavity 25 of display member/portion 22, with panels 70 being lockingly affixed to support base 21. In this way, the desired display/feature element 23 is quickly and easily mounted in position within display member/portion 22, completing the assembly of foldable, three-dimensional display system 20 in a quick and easy manner.

In FIG. 12, a further alternate assembly embodiment of the present invention is depicted as shown as views A, B, and C. In this embodiment, display/feature element 23 comprises a template, depicted as a circular disk, on which any desired visual image can be printed, drawn, pasted, mounted, etc. In addition, display/feature element 23 may be formed in a wide variety of alternate configurations shapes, etc., with it being understood that the circular disk is merely representative of the various constructions that can be employed.

As shown, in this embodiment, display/feature element 23 is inserted through panels 30-39 forming display member/portion 22 for being positioned in cavity 25. In this way, the desired visual image placed on display/feature element 23 is readily viewable through display member/portion 22 with the assembly of foldable, three-dimensional display system 20 being achieved in a rapid, easy manner.

As detailed above, one of the unique aspects of the present invention is the incorporation of cavity 25 in display member/portion 22 which enables the rapid assembly of display system 20 with any desired display or feature element 23 mounted therein. In addition to this unique and desirable result, the incorporation of cavity 25 in display member/portion 22 also enables a user or manufacturer of display system 22 to incorporate foldable, three-dimensional objects in display system 20. In this regard, by manufacturing any desired foldable three-dimensional object and securely mounting the object to either base portion 21 or display member/portion 22, a uniquely constructed three-dimensional foldable display system 20 is realized with a three-dimensional object retained therein which can be completely seen or viewed by the recipient from all directions.

In FIGS. 13-16, three-dimensional, foldable, display system 20 is depicted incorporating base portion 21 and display member/portion 22. In addition, display or feature element 23 is depicted therein, comprising a foldable, three-dimensional building or structure 75. As is evident from a review of FIGS. 13-16, the walls forming building or structure 75 are readily viewable through display member/portion 22, providing a unique and distinctive three-dimensional, foldable display system 20. By forming building or structure 75 in a particular configuration, such as an individual's business, home, product, or the like, a highly distinctive, attractive, advertising vehicle is achieved, providing the recipient with a three-dimensional, foldable, display system 20 which incorporates a unique and readily viewed and understood display element 23. In this way, a wide variety of desirable marketing and advertising goals and objectives can be attained with an exciting, visually distinctive, interesting and exciting foldable display system 20 being realized.

In FIGS. 17-35, a plurality of alternate embodiments employing the features of the present invention are depicted. In each of these embodiments, various alternate constructions are shown representing the wide variety and versatility of the present invention. In clearly demonstrating the unique aspect of the present invention, it has been detailed above that display member/portion 22 may be configured in a wide variety of alternate sizes and shapes. In this regard, FIGS. 17 and 18 clearly depict two specific variations of the numerous alternate configurations which are attainable by employing the present invention. As shown in FIG. 17, the panel members forming display member/portion 22 are configured with a polygonal shape, while the panel members forming display member/portion 22 are depicted in FIG. 18 as comprising a rectangular shape. Clearly, these two alternate embodiments are merely representative of the numerous alternate constructions and configurations in which the panel members forming display member/portion 22 can be produced, with a wide variety of alternate sizes and shapes resulting therefrom.

In this regard, FIGS. 19-35, are provided as examples of numerous alternate configurations and constructions in which the present invention can be implemented. By referring to these alternate constructions, the broad applicability and variety of the foldable display system 20 of the present invention can be clearly understood.

As shown, the present invention can be constructed with the panels forming display member/portion 22 being shaped and/or configured as a house, an oval, a diamond, a hexagon, a bottle, an hourglass, a heart, a cylinder, a light bulb, a cone, a pyramid, a prison, and a cylinder with at least one rounded end. Furthermore, the panels forming display member/portion 22 can be constructed with any desired size, thereby enabling display system 22 to comprise a greatly enlarged construction, as well as a small, miniaturized construction.

Figure 31:
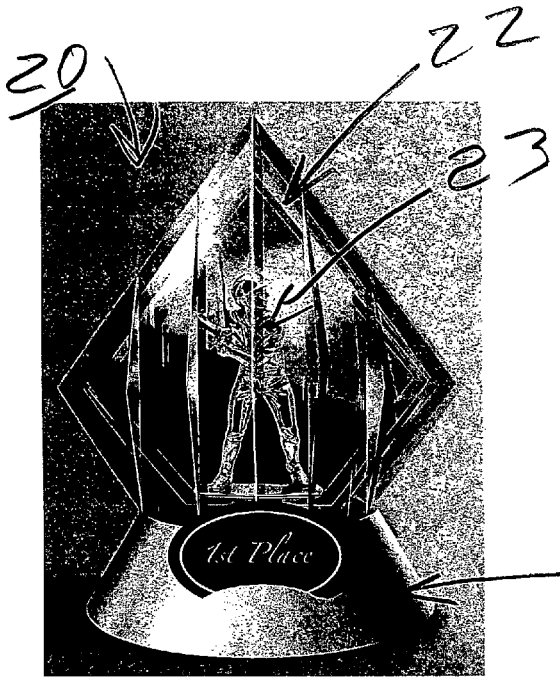
Figure 32:
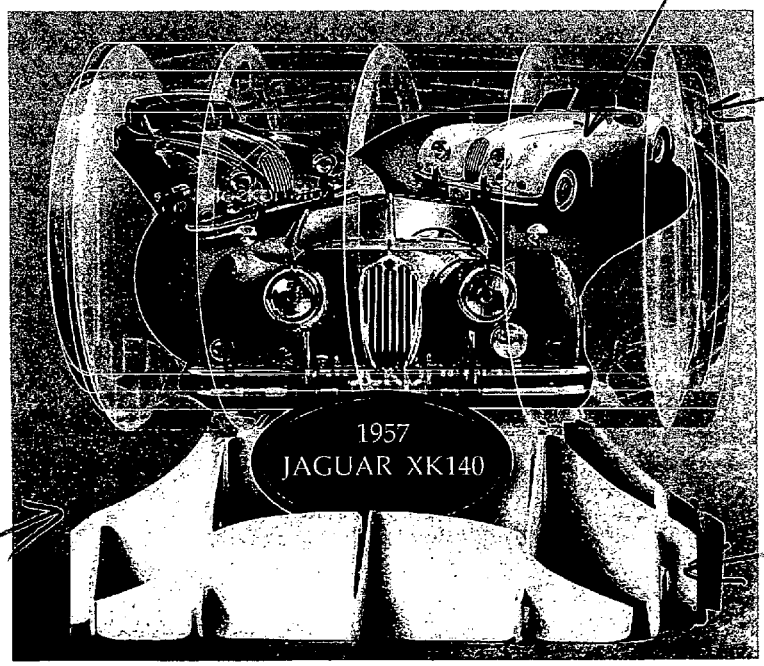
Figure 33:
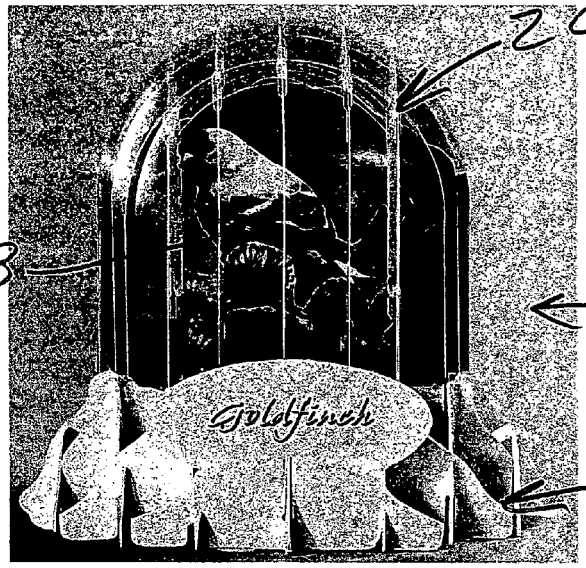
Figure 34:
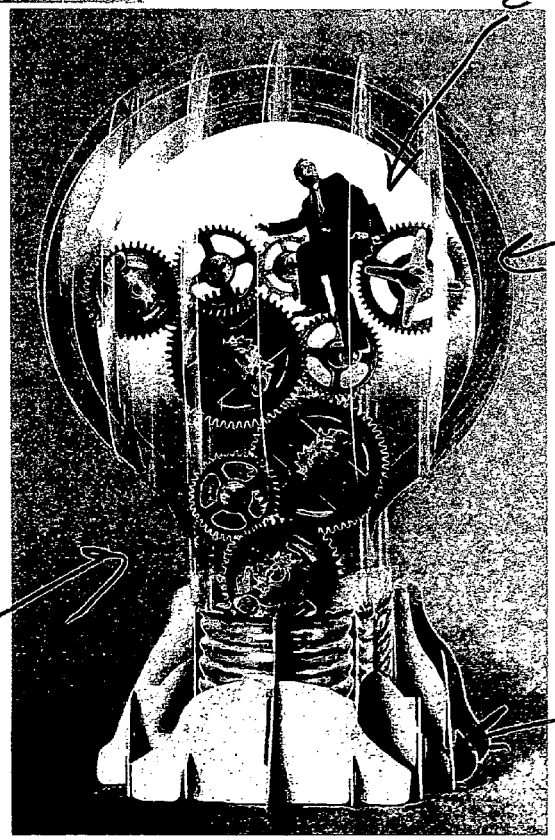

In addition, as shown in these Figures, base portion 21 is also constructed in a wide variety of alternate configurations. As depicted, base portion 21 can be formed from panel members interconnected with each other and having a wide variety of alternate sizes and shapes. Furthermore, base portion 21 can be formed with a continuous, solid panel member peripherally surrounding the outside surface, providing the visual impression of a solid base, as depicted in FIG. 31.

As is also evident from the review of FIGS. 19-35, display/feature element 23 is virtually unlimited, enabling a manufacturer or advertiser to incorporate any desired visually distinctive display or feature element 23 into system 20. As shown, as merely examples thereof, element 23 may comprise furniture, shrubbery, birds, city skylines, fish, boats, photographs of individuals, automobiles, products, etc. As is evident from this disclosure, any desired product, image, design, logo, graphics, etc. can be employed for display element 23.

Figure 30:
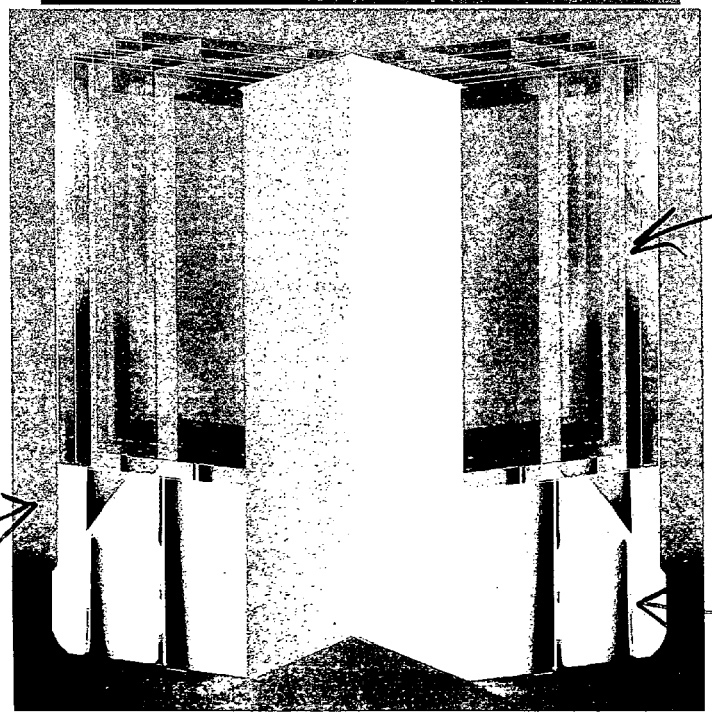

Furthermore, as shown in FIG. 30, display system 20 may also be constructed with a two-part construction, that is either separable in its entirety, or hinged together to enable the portions thereof to be arcuately pivoted relative to each other. In this way, a further unique visual display is realized.

Figure 35:
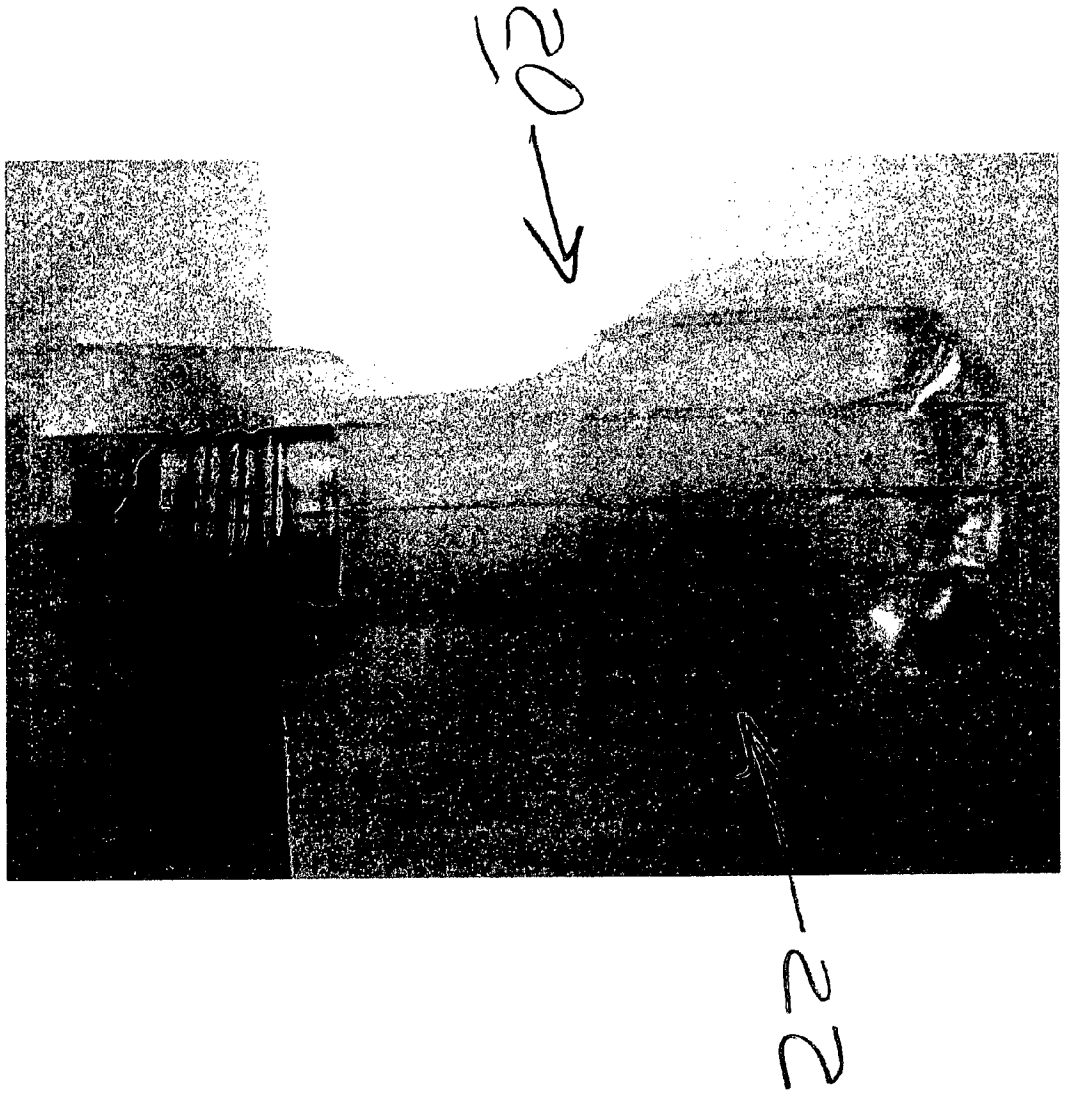

Finally, in FIG. 35, a further unique display system 20 is depicted. In this embodiment, display system 20 comprises a plurality of panel members formed as display member/portion 22, with the panel members being constructed to effectively provide a support base as well as a display member/portion. As result, a single, integrated construction is realized which can employ graphic elements integrated therein, depicted as a light bulb base, as well as incorporating other feature/display elements 23 formed therein for added emphasis or visual impact.

It will thus be seen as the objects set forth above, among those made apparent from the preceding description, are efficiently attained and, since certain changes may be made in the above article without departing from the scope of the invention, it is intended that all matter contained in the above product, image, design, logo, graphics, etc. can be employed for display element 23.

Furthermore, as shown in FIG. 30, display system 20 may also be constructed with a two-part construction, that is either separable in its entirety, or hinged together to enable the portions thereof to be arcuately pivoted relative to each other. In this way, a further unique visual display is realized.

Finally, in FIG. 35, a further unique display system 20 is depicted. In this embodiment, display system 20 comprises a plurality of panel members formed as display member/portion 22, with the panel members being constructed to effectively provide a support base as well as a display member/portion. As result, a single, integrated construction is realized which can employ graphic elements integrated therein, depicted as a light bulb base, as well as incorporating other feature/display elements 23 formed therein for added emphasis or visual impact.

It will thus be seen as the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim is new and desire to secure by Letters Patent is:

1. A three-dimensional display assembly comprising:

a support base that is movable between a first collapsed, substantially flat configuration and a second three-dimensional configuration; and a graphic element cooperatingly associated with said support base; and a display member secured to said support base, said display member being movable between a first collapsed, substantially flat configuration and a second three-dimensional configuration in cooperation with movement of said support base, and at least two panels, at least one of which allows for viewing said graphic element therethrough, said panels at least partially peripherally surrounding and defining a cavity wherein said graphic element is positioned, said panels comprising at least a front wall member and a rear wall member, with each of said front and rear wall members being lockingly interconnected to adjacent panel member adjacent both side edges thereof, thereby defining the dimensions of the cavity, with at least one of said front wall member, said rear wall member, and said adjacent panel members being connected to said support base, and being formed from thin, flexible material, and the front wall member and rear wall member each incorporating elongated slots formed in the flexible material extending along both side edges thereof in juxtaposed, spaced, parallel relationship to each other, and wherein the at least two defining panels further comprises two sidewall members that are further defined as comprising locking tabs formed on both side edges thereof constructed for being inserted into and retained within the elongated slot of the front wall member and rear wall member, thereby enabling the cavity to be quickly and easily constructed.

2. The display assembly defined in claim 1, wherein at least one of said panels in said plurality of panels are further defined as being formed from material selected from the group consisting of transparent materials and translucent materials.

3. The display assembly defined in claim 2, wherein each of the at least two cavity defining panels are further defined as comprising a shape selected from the group consisting of circles, rectangles, squares, polygons, triangles, ovals, irregular shapes, and curved cylindrical segments.

4. The display assembly defined in claim 3, wherein each of the at least two cavity defining panels are further defined as having identical shapes.

5. The display assembly defined in claim 1, wherein each of the two sidewall members are further defined as comprising support arms extending from the lower edge thereof and constructed for mating, interengagement with the support base of the display assembly, thereby enabling the display member to be quickly and easily securely affixed to the support base in peripheral surrounding relationship with any graphic element mounted to the base.

6. The display assembly defined in claim 1, wherein said display member is further defined as comprising a first plurality of cooperating segments, each of said segments incorporating an overall shape constructed for enhancing the visual appearance of the display member and for being secured to the two sidewall members for extending therebetween in juxtaposed, spaced, parallel relationship to each other and to the front wall member and the rear wall member.

7. The display assembly defined in claim 6, when said display members are further defined as comprising a second plurality of cooperating segments, each of said segments incorporating an overall shape constructed for enhancing the visual appearance of the display member and for being secured to the front wall member and the rear wall member for extending therebetween in juxtaposed, spaced, parallel relationship to each other and to the sidewall members.

8. The display assembly defined in claim 7, wherein said first plurality of cooperating segments are further defined as being mounted along the top edges of both sidewall members and the second plurality of cooperating segments are further defined as being mounted along the top edges of the front wall member and rear wall member, and at least one of the first and second plurality of cooperating segments are defined as comprising transparent material.

9. The display assembly defined in claim 8, wherein at least one of said first and second plurality of segments further defines a shape of said cavity and are constructed for being mounted to the cavity defining panels in surrounding engagement therewith for effectively establishing the upper terminus of the internal cavity.

10. The display assembly defined in claim 9, wherein each of the first and second plurality of segments each comprise locking fingers formed at each terminating end thereof and constructed for locking engagement with the lower edge of an associating cavity defining panel.

11. The display assembly defined in claim 10, wherein each of the first and second plurality of segments each comprise a pair of slits formed in the inside edge that defines the shape of said cavity with said slits being cooperatively associated with the locking fingers to assure secure mounting of the segments to one of said cavity defining panels.

12. The display assembly defined in claim 1, wherein the base comprises a plurality of flat panels interconnected with each other to form a foldable assembly.

13. The display assembly defined in claim 12, wherein said graphic element is defined as being securely affixed to the support base.

14. The display assembly defined in claim 12, wherein said graphic element is further defined as comprising one selected from the group consisting of a plurality of flat panels, a three-dimensional foldable structure, a single graphic element, and visually distinct designed drawings and composite graphic elements.

15. A three-dimensional display assembly comprising:

a graphic element comprising indicia thereon;

a foldable display member with which said graphic element is associated, said foldable display member being movable from a first collapsed, substantially flat configuration into a second, erect three-dimensional configuration, and incorporating a plurality of cooperatively associated panels positioned for at least partially peripherally surrounding the graphic element and enabling the graphic element to be viewed therethrough, said panels peripherally surrounding and defining a cavity in which said graphic element is positioned; and said panels comprising at least two cavity defining panels comprising at least a font wall member and a rear wall member, with each of said front and rear wall members being lockingly interconnected to adjacent panel members adjacent both side edges therof, thereby defining the dimensions of the cavity; and being formed from thin, flexible material, and the front wall member and rear wall member each incorporate elongated slots formed in the flexible material extending along both side edges thereof in juxtaposed, spaced, parallel relationship to each other, and wherein the at least two defining panels further comprises two side wall members that are further defined as comprising locking tabs formed on both side edges thereof constructed for being inserted into and retained within the elongated slot of the front wall member and rear wall member, thereby enabling the cavity to be quickly and easily constructed.

16. The display assembly defined in claim 15, wherein said graphic element is visually distinctive and is further defined as comprising at least one sheet of material on which desired indicia is printed.

17. The display assembly defined in claim 16, wherein said indicia comprises one or more selected from the group consisting of pictures, colors, graphics, logos, alphanumeric displays, and cutouts.

18. The display assembly defined in claim 16, wherein said visually distinctive graphic element comprises a plurality of cooperating panels each of which are interconnected to each other to form the desired display.

19. The display assembly defined in claim 16, wherein said graphic element comprises one selected from the group consisting of paper, cardboard, and plastic.

20. The display assembly defined in claim 16, wherein said plurality of panels is further defined as comprising at least four cavity defining panels comprising a front wall member, a rear wall member, and two sidewall members, with each of said panel members being lockingly interconnected to adjacent panel members adjacent both side edges thereof, thereby defining the dimensions of the cavity.

21. A three-dimensional display system said system comprising:

a foldable display member movable between a first collapsed, substantially flat configuration and second, erect three-dimensional configuration, and incorporating a plurality of panels interconnected with each other and arranged for providing a desired display configuration, said plurality of panels comprising a first set of panel members formed from thin, flexible material and positioned in juxtaposed spaced parallel relationship to each other, each panel member comprising a substantially flat configuration with terminating edges, and incorporating elongated slots formed in the flexible material extending along both side edges thereof in juxtaposed, spaced parallel relationship to each other, a second set of panel members positioned in juxtaposed spaced parallel relationship to each other, each panel member comprising a substantially flat configuration with terminating edges, comprising locking tabs formed on both side edges thereof constructed for being inserted into and retained within the elongated slots of the first set of panel members, at least one member of said second set of panel members being interconnected with at least one member of said first set of panel members inwardly of said terminating edges of said panel member of said first set, and at least one member of said first set of panel members being inter-connected with at least one member of said second set of panel members inwardly of said terminating edges of said panel members inwardly of said terminating edges of said panel member of said second set, wherein said panel members provide a display zone;

a graphic element cooperatively associated with the display member and being cooperatively mounted with at least one panel member and located in said display zone such that said graphic element is at least partially peripherally surrounded by said panel members and viewable therethrough.

22. The display assembly defined in claim 21, wherein said graphic element that is visually distinctive and is further defined as comprising at least one separate sheet of material on which desired visually distinctive indicia is printed.

23. The display assembly defined in claim 22, wherein said graphic element comprises a plurality of cooperating panels each of which are interconnected to said at least one panel of said display member to form the desired display.

24. The display assembly defined in claim 21, wherein said graphic element incorporates mounting means for enabling said element to be quickly mounted to said at least one panel of said display member.

* * * * *